US012215549B2

(12) United States Patent
Silveus, III et al.

(10) Patent No.: US 12,215,549 B2
(45) **Date of Patent: *Feb. 4, 2025**

(54) DRILL BIT

(71) Applicant: Ulterra Drilling Technologies, L.P., Fort Worth, TX (US)

(72) Inventors: Jorge Arthur Silveus, III, Fort Worth, TX (US); Alfred Harold Skinner, Aledo, TX (US); Benjamin Chrest, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/049,472

(22) Filed: Oct. 25, 2022

(65) Prior Publication Data

US 2023/0175322 A1 Jun. 8, 2023

Related U.S. Application Data

(63) Continuation of application No. 16/676,913, filed on Nov. 7, 2019, now Pat. No. 11,480,016, which is a continuation-in-part of application No. 16/188,227, filed on Nov. 12, 2018, now Pat. No. 11,008,814.

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/43; E21B 10/55
See application file for complete search history.

(56) References Cited

U.S. PATENT DOCUMENTS

| | | | | |
|---|---|---|---|---|
| 2,708,105 | A | 5/1955 | Williams, Jr. | |
| 3,174,564 | A | 3/1965 | Morlan | |
| 5,549,171 | A * | 8/1996 | Mensa-Wilmot | E21B 10/43 175/431 |
| 5,655,614 | A | 8/1997 | Azar | |

(Continued)

FOREIGN PATENT DOCUMENTS

| | | | |
|---|---|---|---|
| CA | 1221087 | A | 4/1987 |
| CN | 104066920 | A | 9/2014 |

(Continued)

OTHER PUBLICATIONS

U.S. Appl. No. 14/626,736, Final Office Action mailed on Oct. 3, 2018, 22 pages.

(Continued)

*Primary Examiner* — Matthew R Buck
(74) *Attorney, Agent, or Firm* — Kilpatrick Townsend & Stockton LLP

(57) ABSTRACT

A drill bit including a body having a face and a plurality of blades disposed on the face of the body. Each of the plurality of blades may have a row of cutters disposed thereon, and the rows of cutters may collectively define a cutting profile of the drill bit. At least some of the cutters along the cutting profile may have alternating positive back rake angles. The difference between a majority of back rake angles on adjacent cutters along the cutting profile may be less than 20°.

19 Claims, 19 Drawing Sheets

(56) References Cited

U.S. PATENT DOCUMENTS

| | | | | |
|---|---|---|---|---|
| 6,164,394 | A * | 12/2000 | Mensa-Wilmot | E21B 10/567 175/431 |
| 6,296,069 | B1 | 10/2001 | Lamine et al. | |
| 6,536,543 | B2 * | 3/2003 | Meiners | E21B 10/43 175/336 |
| 6,615,934 | B2 * | 9/2003 | Mensa-Wilmot | E21B 10/55 175/431 |
| 8,839,886 | B2 | 9/2014 | Jones et al. | |
| 9,556,683 | B2 * | 1/2017 | Simmons | E21B 10/43 |
| 10,563,463 | B2 | 2/2020 | Simmons et al. | |
| 10,570,665 | B2 | 2/2020 | Maw et al. | |
| 11,008,814 | B2 * | 5/2021 | Silveus, III | E21B 10/55 |
| 11,480,016 | B2 * | 10/2022 | Silveus, III | E21B 10/43 |
| 2010/0193253 | A1 | 8/2010 | Massey et al. | |
| 2010/0326742 | A1 * | 12/2010 | Vempati | E21B 10/43 175/431 |
| 2011/0005841 | A1 | 1/2011 | Wood et al. | |
| 2011/0108326 | A1 | 5/2011 | Jones et al. | |
| 2012/0186879 | A1 | 7/2012 | Durairajan et al. | |
| 2012/0234610 | A1 * | 9/2012 | Azar | E21B 10/43 175/431 |

FOREIGN PATENT DOCUMENTS

| | | | |
|---|---|---|---|
| CN | 104364460 | A | 2/2015 |
| CN | 104619946 | A | 5/2015 |
| CN | 105683484 | A | 6/2016 |
| CN | 112601873 | A | 4/2021 |
| SU | 791890 | | 12/1980 |

OTHER PUBLICATIONS

U.S. Appl. No. 14/626,736, Final Office Action mailed on Sep. 4, 2019, 25 pages.
U.S. Appl. No. 14/626,736, Non-Final Office Action mailed on Mar. 22, 2018, 19 pages.
U.S. Appl. No. 14/626,736, Non-Final Office Action mailed on Mar. 15, 2019, 22 pages.
U.S. Appl. No. 14/626,736, Non-Final Office Action mailed on Apr. 28, 2017, 23 pages.
U.S. Appl. No. 14/626,736, Notice of Allowance mailed on Nov. 20, 2019, 10 pages.
U.S. Appl. No. 15/396,409, Final Office Action mailed on Feb. 12, 2019, 8 pages.
U.S. Appl. No. 15/396,409, Final Office Action mailed on Sep. 26, 2019, 8 pages.
U.S. Appl. No. 15/396,409, Non-Final Office Action mailed on Jun. 11, 2019, 10 pages.
U.S. Appl. No. 15/396,409, Non-Final Office Action mailed on Aug. 24, 2018, 9 pages.
U.S. Appl. No. 15/396,409, Notice of Allowance mailed on Nov. 29, 2019, 5 pages.
U.S. Appl. No. 16/188,227, Final Office Action mailed on Jun. 24, 2020, 11 pages.
U.S. Appl. No. 16/188,227, Non-Final Office Action mailed on Jan. 29, 2020, 11 pages.
U.S. Appl. No. 16/188,227, Non-Final Office Action mailed on Oct. 9, 2020, 13 pages.
U.S. Appl. No. 16/188,227, Notice of Allowance mailed on Mar. 10, 2021, 6 pages.
U.S. Appl. No. 16/676,913, Final Office Action mailed on Apr. 13, 2021, 7 pages.
U.S. Appl. No. 16/676,913, Non-Final Office Action mailed on Nov. 6, 2020, 13 pages.
U.S. Appl. No. 16/676,913, Notice of Allowance mailed on Jun. 22, 2022, 5 pages.
International Application No. PCT/US2015/016684, International Preliminary Report on Patentability mailed on Sep. 1, 2016, 7 pages.
International Application No. PCT/US2019/060215, International Preliminary Report on Patentability mailed on May 20, 2021, 9 pages.
International Application No. PCT/US2019/060215, International Search Report and Written Opinion mailed on May 7, 2020, 11 pages.
Canadian Application No. CA3,118,695, Office Action, Mailed On Jan. 22, 2024, 4 pages.
Chinese Application No. CN201980074064.7, Notice of Decision to Grant, Mailed On May 23, 2024, 6 pages.
Canadian Application No. CA3,118,695 , Office Action, Mailed On Oct. 11, 2024, 4 pages.

* cited by examiner

DRILL BIT

CROSS-REFERENCE TO RELATED APPLICATIONS

This application is a continuation of U.S. Ser. No. 16/676,913, filed Nov. 7, 2019 which is a continuation-in-part of U.S. Ser. No. 16/188,227, filed Nov. 12, 2018, now U.S. Pat. No. 11,008,814, issued May 18, 2021, the contents of which are hereby incorporated by reference in their entireties for all purposes.

FIELD OF THE INVENTION

The present disclosure generally relates to drill bits having blades with improved cutter arrangements. In particular, the disclosure relates to a drill bit comprising a blade having cutters thereon, the cutters having alternating back rake angles.

BACKGROUND OF THE INVENTION

Drill bits, such as rotary drag bits, reamers, and similar downhole tools for boring or forming holes in subterranean rock formations are well-known. When drilling oil and natural gas wells, rotary drag bits drag discrete cutting structures, referred to as "cutters," mounted in fixed locations on the body of the tool against the formation. As the cutters are dragged against the formation by rotation of the tool body, the cutters fracture the formation through a shearing action. This shearing action forms small chips that are evacuated hydraulically by drilling fluid pumped through nozzles in the tool body.

One such fixed cutter, earth boring tool, generally referred to in the oil and gas exploration industry as a polycrystalline diamond compact or PDC bit, employs fixed cutters. Each cutter has a highly wear resistant cutting or wear surface comprised of PDC or similar highly wear resistant material. PDC cutters are typically made by forming a layer of polycrystalline diamond (PCD), sometimes called a crown or diamond table, on an erosion resistant substrate. The PDC wear surface is comprised of sintered polycrystalline diamond (either natural or synthetic) exhibiting diamond-to-diamond bonding. Polycrystalline cubic boron nitride, wurtzite boron nitride, aggregated diamond nanotubes (ADN) or other hard, crystalline materials are known substitutes and may be useful in some drilling applications. A compact is made by mixing a diamond grit material in powder form with one or more powdered metal catalysts and other materials, forming the mixture into a compact, and then sintering it, typically with a tungsten carbide substrate using high heat and pressure or microwave heating. Sintered compacts of polycrystalline cubic boron nitride, wurtzite boron nitride, ADN and similar materials are, for the purposes of description contained below, equivalents to polycrystalline diamond compacts and, therefore, a reference to "PDC" in the detailed description should be construed, unless otherwise explicitly indicated or context does not allow, as a reference to a sintered compacts of polycrystalline diamond, cubic boron nitride, wurtzite boron nitride and other highly wear resistant materials. References to "PDC" are also intended to encompass sintered compacts of these materials with other materials or structure elements that might be used to improve its properties and cutting characteristics. Furthermore, PDC encompasses thermally stable varieties in which a metal catalyst has been partially or entirely removed after sintering.

Substrates for supporting a PDC wear surface or layer are typically made, at least in part, from cemented metal carbide, with tungsten carbide being the most common. Cemented metal carbide substrates are formed by sintering powdered metal carbide with a metal alloy binder. The composite of the PDC and the substrate can be fabricated in a number of different ways. It may also, for example, include transitional layers in which the metal carbide and diamond are mixed with other elements for improving bonding and reducing stress between the PCD and substrate.

Each PDC cutter is fabricated as a discrete piece, separate from the drill bit. Because of the processes used for fabricating them, the PCD layer and substrate typically have a cylindrical shape, with a relatively thin disk of PCD bonded to a taller or longer cylinder of substrate material. The resulting composite can be machined or milled to form a desired shape. However, the PCD layer and substrate are typically used in the cylindrical form in which they are made.

Fixed cutters are mounted on an exterior of the body of an earth boring tool in a predetermined pattern or layout. Furthermore, depending on the particular application, the cutters are typically arranged along each of several blades, which are comprised of raised ridges formed on the body of the earth boring tool. Each blade typically includes a flat surface, oriented parallel to the formation being cut. The cutters are usually disposed in holes or openings along these flat surfaces. In a PDC bit, for example, blades are generally arranged in a radial fashion around the central bit axis (axis of rotation) of the bit. They typically, but do not always, curve in a direction opposite to that of the direction of rotation of the bit.

As an earth boring tool having fixed cutters is rotated, the cutters collectively present one or more predetermined cutting profiles to the earth formation, shearing the formation. A cutting profile is defined by the position and orientation of each of the cutters associated with it as they rotate through a plane extending from the earth boring tool's axis of rotation outwardly (e.g., bit axis). A cutter's position along the cutting profile is primarily a function of its lateral displacement from the bit axis (axis of rotation) and not the particular blade on which it lies. Cutters adjacent to each other in a cutting profile are typically not next to each other on the same blade. Conversely, cutters that are adjacent to one another in a cutting profile are typically on different blades.

In addition to position or location on the bit, each cutter has a three-dimensional orientation. Generally, this orientation will be defined with respect to one of two coordinate frames: a coordinate frame of the bit, defined in reference to its axis of rotation; or a coordinate frame generally based on the cutter itself. The orientation of a cutter is usually specified in terms of a back inclination or rotation of the cutter and a side inclination or rotation of the cutter. Back inclination or "back rake" is specified in terms of an axial rake or back rake angle, depending on frame of reference used. Side inclination or "side rake" is typically specified in terms lateral rake or side rake angle, depending on the frame of reference used. Such drill bits are described, for example, in U.S. Pat. No. 9,556,683, the entirety of which is incorporated herein by reference.

U.S. Pat. No. 5,549,171 describes a fixed cutter drill bit that includes sets of cutter elements mounted on the bit face. Each set includes at least two cutters mounted on different blades at generally the same radial position with respect to the bit axis but having differing degrees of back rake. The cutter elements of a set may be mounted having their cutting faces out-of-profile, such that certain elements in the set are exposed to the formation material to a greater extent than other cutter elements in the same set. The cutter elements in a set may have cutting faces and profiles that are identical, or they may vary in size or shape or both. The bit exhibits increased stability and provides substantial improvement in ROP (rates of penetration) without requiring excessive WOB (weight on bit).

U.S. Pat. No. 6,164,394 describes a fixed cutter drill bit particularly suited for plastic shale drilling. The bit includes rows of cutter elements arranged so that the cutting tips of the cutters in a row are disposed at leading and lagging angular positions so as to define a serrated cutting edge. The angular position of the cutting tips of cutters in a given row may be varied by mounting cutters with different degrees of positive and negative back rake along the same blade. Preferably, within a segment of a given row, the cutters alternate between having positive back rake and negative back rake while the cutters mounted with positive back rake are more exposed to the formation material than those mounted with negative back rake. Nozzles are provided with a highly lateral orientation for efficient cleaning. The positive back rake cutter elements have a dual-radiused cutting face and are mounted so as to have a relief angle relative to the formation material. Cutter elements in different rows are mounted at substantially the same radial position but with different exposure heights, the cutter elements with positive back rake being mounted so as to be more exposed to the formation than those with negative back rake.

Although drill bits having varied configurations of cutters are known, the need remains for drill bits having cutters configured for improved formation failing efficiency, ROP (rates of penetration) and stability.

SUMMARY OF THE INVENTION

In some aspects, the present disclosure is directed to a drill bit having a blade and a row of cutters on the blade, the row of cutters having alternating back rake angles.

In some aspects, the present disclosure is directed to a drill bit having a body having a face and a central bit axis, a blade disposed on the face of the body, and a row of cutters disposed on the blade. At least some of the cutters may have alternating positive back rake angles. In some embodiments, the difference between a majority of back rake angles on adjacent cutters may be less than 20°.

In some embodiments, the difference between the back rake angles on two adjacent cutters may be greater than the difference between the back rake angles on another two adjacent cutters that may be disposed radially further outward. In some embodiments, the difference between the back rake angles on two adjacent cutters may be less than the difference between the back rake angles on another two adjacent cutters that may be disposed radially further outward. In some embodiments, the back rake angles on every other cutter may gradually increase as the cutters may be disposed radially further outward. In some embodiments, the back rake angles on every other cutter may gradually decrease as the cutters may be disposed radially further outward.

In some embodiments, the face may include a cone section disposed about the central bit axis. At least one cutter may have a back rake angle less than the back rake angles on adjacent cutters. One of the adjacent cutters may be disposed on the cone section.

In some embodiments, the face may include a cone section disposed about the central bit axis and a nose section surrounding the cone section. At least one cutter may have a back rake angle less than the back rake angles on adjacent cutters. The at least one cutter may be disposed on the nose section.

In some embodiments, the face may include a cone section disposed about the central bit axis, a nose section surrounding the cone section, and a shoulder section disposed radially outward from the cone and nose sections. At least one cutter may have a back rake angle greater than the back rake angles on adjacent cutters. The at least one cutter may be disposed on the shoulder section.

In some embodiments, each cutter of the row of cutters may have a cutter face forming a cutting surface and a longitudinal cutter axis passing through the cutter face. The cutter face of at least one cutter may be slanted with respect to the longitudinal cutter axis of the at least one cutter.

In some embodiments, the face may include a cone section. The cutters having alternating positive back rake angles may be disposed on the cone section. In some embodiments, the face may include a shoulder section. The cutters having alternating positive back rake angles may be disposed on the shoulder section.

In some embodiments, the face may include a cone section disposed about the central bit axis and a shoulder section disposed radially outward from the cone section. The cutters having alternating positive back rake angles may be disposed on the cone section and the shoulder section. In some embodiments, the face may include a gauge section. The cutters having alternating positive back rake angles may be disposed on the gauge section.

In some embodiments, the face may include a cone section disposed about the central bit axis, a nose section surrounding the cone section, a shoulder section disposed radially outward from the cone and nose sections, and a longitudinally extending gauge section. The row of cutters may extend from the cone section to the gauge section. The cutters having alternating positive back rake angles may be disposed on at least one of the cone section, the nose section, the shoulder section or the gauge section.

In some embodiments, at least some of the cutters having alternating positive back rake angles may also have alternating side rake angles. In some embodiments, when the row of cutters may be a row of primary cutters, the drill bit may further include a row of back-up cutters. In some embodiments, when the row of cutters may be a row of back-up cutters, the drill bit may further include a row of primary cutters.

In some embodiments, the blade may include an inner region and an outer region rotationally offset from the inner region. The row of cutters may be disposed on at least one of the inner region, the outer region, or combinations thereof. In some embodiments, the row of cutters further may include cutters that do not have alternating positive back rake angles.

In some aspects, the present disclosure is directed to a drill bit having a body having a face and a central bit axis, a blade disposed on the face of the body, and a plurality of first and second cutters arranged in an alternating manner on the blade. In some embodiments, the plurality of first cutters may each have a positive back rake angle within a first range of ±9°. The plurality of second cutters may each have a positive back rake angle within a second range of ±9°. In some embodiments, the difference of the average of the first range and the average of the second range may be from 5 to 20°.

In some embodiments, the plurality of first cutters may each have a positive back rake angle within a first range of ±9°. The plurality of second cutters may each have a positive back rake angle within a second range of ±9°. The difference of the average of the first range and the average of the second range may be from 5 to 10°.

In some embodiments, the plurality of first cutters may each have a positive back rake angle within a first range of ±9°. The plurality of second cutters may each have a positive back rake angle within a second range of ±9°. The difference of the average of the first range and the average of the second range may be from 10 to 20°.

In some embodiments, the plurality of first cutters may each have a positive back rake angle within a first range of ±5°. The plurality of second cutters may each have a positive back rake angle within a second range of ±5°. The difference of the average of the first range and the average of the second range may be from 5 to 20°.

In some embodiments, the face may include a cone section disposed about the central bit axis and a shoulder section disposed radially outward from the cone section. At least some of alternating first and second cutters may be disposed on at least one of the cone section or the shoulder section.

In some embodiments, the face may include a nose section and a shoulder section disposed radially outward from the nose section. At least some of the alternating first and second cutters may be disposed on the nose section and the shoulder section.

In some embodiments, at least some of the plurality of first cutters further have non-zero side rake angles. In some embodiments, the blade may include an inner region and an outer region rotationally offset from the inner region. At least some of the plurality of first and second cutters may be disposed on at least one of the inner region or the outer region.

In some aspects, the present disclosure is directed to a drill bit having a body, a blade disposed on the body, and at least two pairs of cutters on the blade. The body may have a central bit axis about which the drill bit may be intended to rotate. The cutters in each of the pairs of cutters may be mounted in adjacent, fixed positions on the blade. The cutters may partially define at least a portion of a cutting profile for the drill bit when the drill bit may be rotated. Each of the cutters may have a predetermined radial position within the cutting profile based on its distance from the central bit axis. Each of the cutters may have a predetermined orientation for its cutting face. The predetermined orientation may include different non-zero back rake angles on each of the cutters within the at least two pairs of cutters. The cutters in each pair of cutters may have different back rake angles with respect to the other of the cutters within each pair of cutters. In some embodiments, the difference between the back rake angles within each of the pairs of the cutters may be less than 20°. In some embodiments, the difference between the back rake angles within each of the pairs of the cutters may be less than 10°.

In some embodiments, the predetermined orientation may further include a non-zero side rake angle. In some embodiments, each pair of cutters in the at least two pairs of cutters may have side rake angles that converge on one another. In some embodiments, at least one of the two pairs of cutters may be disposed in a cone section of the cutting profile. In some embodiments, at least one of the two pairs of cutters may be disposed in a shoulder section of the cutting profile.

In some aspects, the present disclosure is directed to a drill bit having a body. The body may have a face on which may be defined a plurality of blades extending from the face and separated by channels between the blades. Each blade may support a plurality of cutters. At least one of the blades may be an offset blade, which may include an inner region and an outer region. The inner region may support an inner set of cutters along a first leading edge portion of the offset blade. The outer region may support an outer set of cutters along a second leading edge portion of the offset blade. The second leading edge portion may be rotationally offset from the first leading edge portion. At least one of the inner set of cutters or the outer set of cutters may have alternating positive back rake angles. In some embodiments, the difference between adjacent back rake angles may be less than 20°. In some embodiments, the difference between adjacent back rake angles may be less than 10°.

In some embodiments, the inner set of cutters may have alternating positive back rake angles. In some embodiments, the outer set of cutters may have alternating positive back rake angles. In some embodiments, the inner set of cutters and the outer set of cutters may have alternating positive back rake angles. In some embodiments, at least one of the inner set of cutters or the outer set of cutters may have alternating side rake angles.

In some aspects, the present disclosure is directed to a method of using a drill bit. The method may include disposing a drill bit to drill a borehole. The method may further include drilling the borehole with the drill bit. The drill bit may include a body having a face and a central bit axis, a blade disposed on the face of the body, and a row of cutters disposed on the blade. At least some of the cutters may have alternating positive back rake angles. In some embodiments, the difference between a majority of back rake angles on adjacent cutters may be less than 20°.

In some aspects, the present disclosure is directed to a method of drilling a subterranean formation. The method may include engaging a subterranean formation with at least one cutter of a drill bit. The drill bit may include a body having a face and a central bit axis, a blade disposed on the face of the body, and a plurality of first and second cutters arranged in an alternating manner on the blade. The plurality of first cutters may each have a positive back rake angle within a first range of ±9°. The plurality of second cutters may each have a positive back rake angle within a second range of ±9°. In some embodiments, the difference of the average of the first range and the average of the second range may be from 5 to 20°.

In some aspects, the present disclosure is directed to a method of configuring a drill bit. The method may include configuring a bit body having a face and a central bit axis. The method may also include configuring a blade on the face of the body. The method may further include configuring a row of cutters on the blade. At least some of the cutters may be configured to have alternating positive back rake angles. The difference between a majority of back rake angles on adjacent cutters may be less than 20°.

In some aspects, the present disclosure is directed to a method of making a drill bit. The method may include providing a bit body having a face and a blade on the face. The method may further include providing a row of cutters on the blade based on a predetermined back rake angle arrangement such that at least some of the cutters may have alternating positive back rake angles. The difference between a majority of back rake angles on adjacent cutters may be less than 20°.

In some aspects, the present disclosure is directed to a drill bit including a plurality of cutters having alternating back rake angles along a cutting profile.

In some aspects, the present disclosure is directed a drill bit including a body having a face and a central bit axis and a plurality of blades disposed on the face of the body. Each of the plurality of blades may include a row of cutters disposed thereon. The rows of cutters may collectively define a cutting profile of the drill bit. At least some of the cutters along the cutting profile may have alternating positive back rake angles. The difference between a majority of back rake angles on adjacent cutters along the cutting profile may be less than 20°.

In some embodiments, adjacent cutters of the at least some of the cutters along the cutting profile having alternating positive back rake angles may be disposed on different blades.

In some embodiments, at least some cutters of the row of cutters disposed on one blade of the plurality of blades may have alternating positive back rake angles.

In some embodiments, the at least some of the cutters along the cutting profile having alternating positive back rake angles may include a first plurality of cutters and a second plurality of cutters. Each of the first plurality of cutters may have a positive back rake angle within a first range. Each of the second plurality of cutters may have a positive back rake angle within a second range different from the first range. In some embodiments, the difference of the average of the first range and the average of the second range may be from 5 to 20°.

In some embodiments, at least some of the first plurality of cutters may be disposed on a first blade of the plurality of blades. In some embodiments, at least some of the second plurality of cutters may be disposed on a second blade of the plurality of blades. In some embodiments, the first blade and the second blade may be adjacent to each other.

In some embodiments, the plurality of blades may include a first set of blades and a second set of blades. At least some of the cutters disposed on the first set of blades may have back rake angles within the first range. At least some of the cutters disposed on the second set of blades may have back rake angles within the second range. The first set of blades and the second set of blades may be arranged in an alternating manner.

In some embodiments, the first plurality of cutters may include a first set of at least two adjacent cutters along the cutting profile The second plurality of cutters may include a second set of at least two adjacent cutters along the cutting profile. In some embodiments, the first set and the second set may be arranged in a consecutive manner along the cutting profile.

In some embodiments, the difference between the back rake angles on two adjacent cutters may be greater than the difference between the back rake angles on another two adjacent cutters that may be disposed radially further outward. In some embodiments, the difference between the back rake angles on two adjacent cutters may be less than the difference between the back rake angles on another two adjacent cutters that may be disposed radially further outward.

In some embodiments, the face may include a cone section disposed about the central bit axis. At least some of the cutters having alternating positive back rake angles may be disposed on the cone section.

In some embodiments, the face may include a cone section disposed about the central bit axis and a nose section surrounding the cone section. At least some of the cutters having alternating positive back rake angles may be disposed on at least one of the cone section or the nose section.

In some embodiments, the face may include a cone section disposed about the central bit axis, a nose section surrounding the cone section, and a shoulder section disposed radially outward from the cone and nose sections. At least some of the cutters having alternating positive back rake angles may be disposed on at least one of the cone section, the nose section, or the shoulder section.

In some embodiments, at least some of the cutters having alternating positive back rake angles also have alternating side rake angles. In some embodiments, the rows of cutters may be rows of primary cutters, and each of the plurality of blades may further include a row of back-up cutters. In some embodiments, the rows of cutters may be rows of back-up cutters, and each of the plurality of blades may further include a row of primary cutters.

In some embodiments, at least one of the blades may include an inner region and an outer region rotationally offset from the inner region. At least some of the cutters having alternating positive back rake angles may be disposed on at least one of the inner region, the outer region, or combinations thereof.

In some embodiments, the rows of cutters further comprise cutters that do not have alternating positive back rake angles along the cutting profile.

In some aspects, the present disclosure is directed to a method of using a drill bit. In some embodiments, the method may include drilling a borehole with a drill bit. The drill bit may include a body having a face and a central bit axis, and a plurality of blades disposed on the face of the body. Each of the plurality of blades may include a row of cutters disposed thereon. The rows of cutters may collectively define a cutting profile of the drill bit. At least some of the cutters along the cutting profile may have alternating positive back rake angles. The difference between a majority of back rake angles on adjacent cutters along the cutting profile may be less than 20°.

BRIEF DESCRIPTION OF THE DRAWINGS

The present invention will be better understood in view of the appended non-limiting figures, in which.

DETAILED DESCRIPTION OF THE INVENTION

I. Introduction

Figure 1:
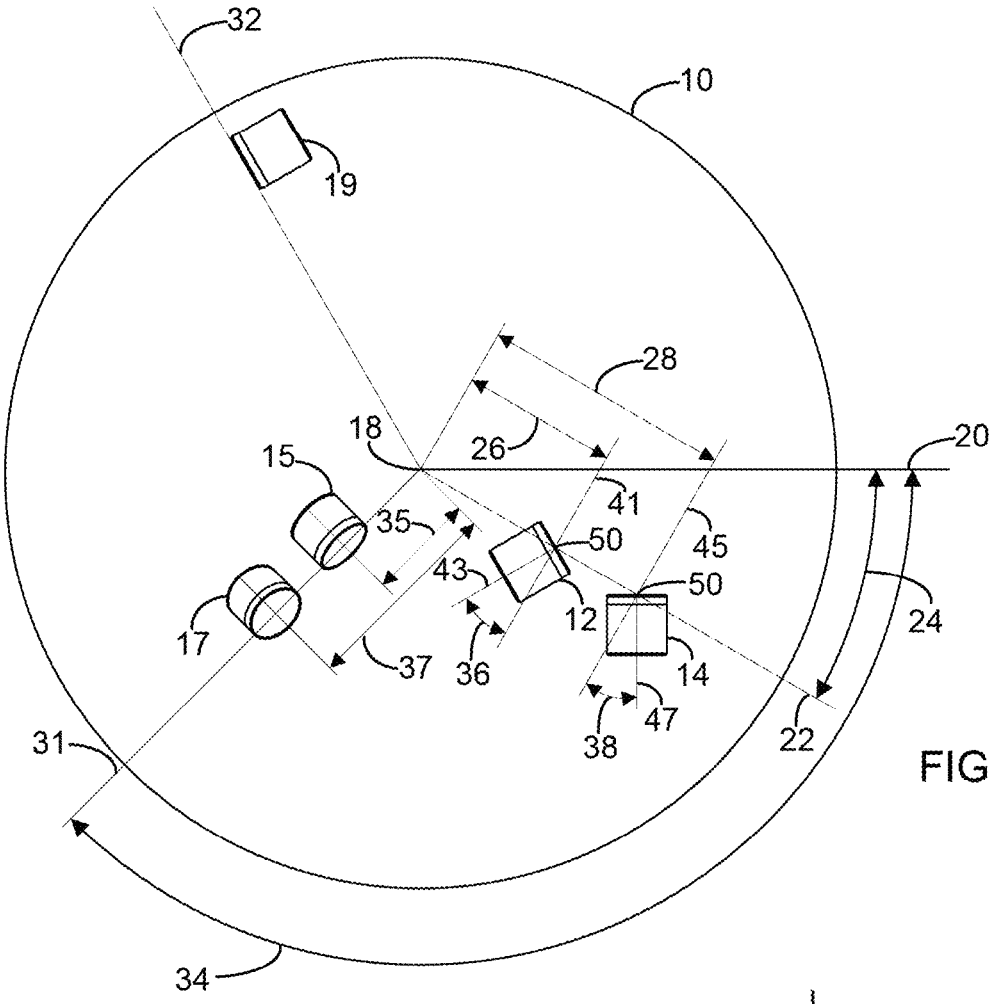
FIG. 1 shows a schematic illustration of a face view of a drill bit, in accordance with some embodiments of the present invention.

The present disclosure is directed to back rake configurations for cutters on a drill bit. The drill bit may include a body having a face, a blade disposed on the face, and a row of cutters disposed on the blade and having alternating positive back rake angles. It has now been discovered that drill bits having alternating positive back rakes surprisingly and unexpectedly may exhibit improved rate of penetration (ROP) and stability over conventional cutter configurations.

In some embodiments, the difference between a majority of back rake angles on adjacent cutters of the row of cutters may be less than 20°. The row of cutters optionally may include a plurality of first and second cutters arranged in an alternating manner on the blade. The plurality of first cutters may each have a positive back rake angle within a first range of ±9°. The plurality of second cutters similarly may each have a positive back rake angle within a second range of ±9°. The difference of the average of the first range and the average of the second range may be from 5 to 20°, e.g., from 5 to 15°, from 5 to 10°, from 10 to 20° or from 15 to 20°.

Advantageously, arranging the cutters on a blade to have alternating passive and aggressive back rakes, a more aggressive drill bit can be obtained. By attacking a formation from different points of contact in a passive and aggressive manner, the formation can be failed more efficiently as crack propagation will initiate in many different angles. Additionally, the alternating back rake arrangements described herein achieve increased bit durability, reduced vibration, and better bit control. The alternating positive back rake angle arrangements described herein result in smoother torque signature, leading to less axial and/or lateral vibration damage and improved dull grading. The back rake arrangements described herein also requires less mechanical specific energy at increased rate of penetration, achieving improved drilling efficiency. The alternating positive back rake angle arrangements can be particularly beneficial for transitional drilling by maintaining ROP (rate of penetration) potential in each dedicated formation.

II. Cutter Arrangement

Cutter geometry varies widely in the industry. In some aspects, the cutter, e.g., PDC cutter, has a generally cylindrically shaped "substrate," with a flat or generally flat top with a layer of polycrystalline diamond (PCD) disposed thereon. The PCD layer is sometimes referred to as a crown or diamond "table" that functions as the cutter's primary working surface. Although in some aspects, the cutters used according to the present disclosure are cylindrical in shape, in other embodiments, the cutters may have an oblong or oval lateral cross section.

Each fixed cutter in a working drag bit will have one or more working surfaces for engaging and fracturing a formation. Fixed cutters on drag bits, reamers and other rotating bodies for boring through rock will typically have at least a predominate portion of their primary cutting surface that is relatively, or substantially, planar or flat. In other aspects, the cutting surface is rounded, cone shaped, or some other shape. Thus, in some aspects, the primary cutting surface of the cutter is flat or relatively flat, while in others it may include bumps, ridges, spokes or other features that disrupt an otherwise substantially flat surface.

Each fixed cutter includes a cutting face comprising one or more surfaces that are intended to face and engage the formation, thereby performing the work of fracturing the formation. These surfaces will tend to experience the greatest reactive force from the formation. For cylindrically shaped cutters, the generally flat PCD layer of the cylinder functions as the primary cutting surface. Therefore, the orientation of this surface can be used to specify the orientation of the cutter on the bit using, for example, a vector normal to the plane of this surface, as well as a vector in the plane of this surface. On a PDC cutter, for example, the primary cutting surface may comprise a top relatively flat surface of the layer of PCD (the table). The cutter surface includes a central or longitudinal "surface axis" extending therethrough in a direction normal to the cutting surface. In addition, each cutter includes a "cutter axis" which extends through the longitudinal axis of the cutter itself. As described below, the surface axis and cutter axis will coincide with one another for longitudinally symmetrical cutters (see, e.g., the cutters of FIGS. 3A and 3B). In other aspects, where the cutter is not entirely longitudinally symmetrical, the surface axis and cutter axis will not be aligned, as shown, for example, in FIGS. 4A-4C.

Exposed sides of the PCD table may perform some work and might be considered to be a working or cutting surface or form part of the cutting face. The outer perimeter of the PDC bits may also comprise, for example, an edge that is beveled or chamfered. Although the cutting surface may be flat or generally flat, in other aspects, the cutting surface may not be entirely flat, and may include one or more ridges, recesses, bumps or other features.

The concepts of cutting profile, back rake, and side rake are explained with reference to FIGS. 1-4. FIG. 1 represents a schematic illustration of a face view of a drill bit. The gauge of the bit is generally indicated by circle 10 and generally corresponds to the maximum width or diameter of the drill bit. For clarity, only five fixed cutters 12, 14, 15, 17, and 19 are illustrated in FIG. 1, although it will be appreciated that drill bits typically include many additional cutters. For purpose of illustration, cutters 12 and 14 are shown having different side rake angles but do not have any back rake. Cutters 15 and 17 are shown having different back rake angles but do not have any side rake. Cutter 19 is shown having neither back rake nor side rake. Although not shown, it is contemplated that a cutter may have both back rake and side rake.

Reference number 18 identifies the center of rotation or longitudinal axis of the drill bit, referred to herein as the "bit axis." Radial line 20 is an arbitrary radial selected to represent zero degree angular rotation around bit axis 18. Fixed cutters 12 and 14 are located generally on the same radial line 22, at the same angular rotation, as indicated by angle 24, but are radially displaced at different distances, 26 and 28, from the bit axis 18. Fixed cutters 15 and 17 are located generally on the same radial line 31, at the same angular rotation, as indicated by angle 34, but are radially displaced at different distances, 35 and 37, from the bit axis 18. Cutters 12 and 14 are located on one blade, and cutters 15 and 17 are located on another blade. For clarity, the blades are not indicated on the schematic representation of FIG. 1. Cutters on the same blade may or may not all lie on the same radial line or at the same angular rotation around bit axis 18. For example, cutters may be aligned on a given blade in a straight radial line or may be aligned in a curved (arcuous) path along a given blade. Cutter 19 lies on the radial line 32, which has a substantially greater angular position than the other cutters. As shown, its radial displacement from the bit axis 18 is greater than the distances of the other four cutters 12, 14, 15, and 17.

a. Cutting Profile

Figure 2:
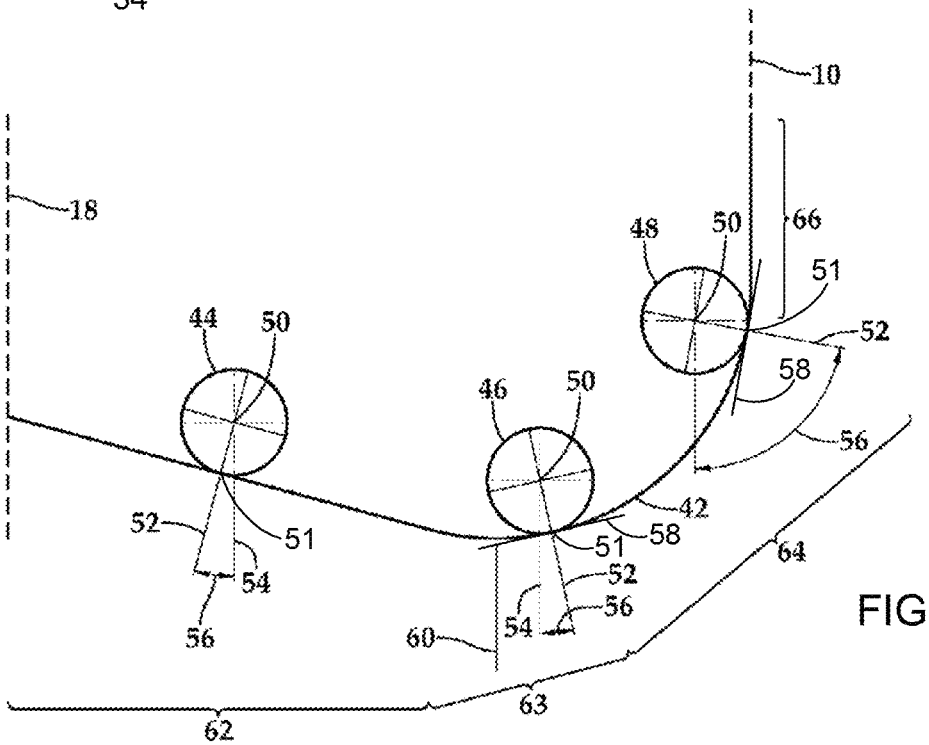
FIG. 2 represents a schematic illustration of a cutting profile of a drill bit, in accordance with some embodiments of the present invention.

FIG. 2 represents a schematic illustration of a cutting profile of a bit. Only three fixed cutters are illustrated for sake of clarity, with the outer diameters of the individual cutters represented by circular outlines 44, 46, and 48, respectively. The profiles of the cutters are formed by rotating their positions to the zero degree angular rotation radial line 20 (FIG. 1) and projecting them into a plane in which the bit axis and the zero degree angular rotation radial line 20 lie. Curve 42, which represents the cutting profile of the bit, touches each cutter at one point, and generally represents the intended cross-sectional shape in the borehole left by the bit as it is penetrating the formation. For purposes of simplifying the illustration, each of the outlines 44, 46 and 48 assumes that the cutters do not have any back rake or side rake. If a cutter had any back rake, such as cutters 15 and 17, or side rake, such as cutters 14 and 16, the projection of the outside diameter of the PCD layer into a plane through the radial line for that cutter would be elliptical.

b. Side Rake Angle

The cutters in FIG. 2 are shown "face on" and have longitudinal symmetry such that point 50 (three are shown, one for each cutter) represent both the cutter axis and the surface axis, which coincide with one another. As shown, cutter/surface axis 50 will be selected, for purposes of example, as the origin of a reference frame for defining side rake of the cutter in the following description.

Line 52 represents the "side rake axis," which is the axis about which the cutter is rotated to establish side rake. The side rake axis 52 is normal to the tangent of the cutting profile at the point 51 where the projection of the cutter diameter 44, 46, 48 touches the bit cutting profile curve 42, and extends through point 50. Side rake axis 52 also lies on the front surface of the cutting surface. The angle of rotation (not indicated in FIG. 2) of a cutter about the side rake axis 52 is its "side rake angle," which is defined as the angle between (1) a line tangent to a circle of rotation for a given cutter, extending through point 50, and (2) the surface axis.

Referring back to FIG. 1, the cutters 12 and 14 are shown having different amounts of side rake, which are indicated by angles 36 and 38, respectively. In the case of cutter 12, the side rake angle 36 is defined between (i) line 41, which is tangent to a circle of rotation for cutter 12, extending through point 50, and (ii) the surface axis 43 of cutter 12. The side rake angle 38 of the cutter 14 is defined between (i) line 45, which is tangent to a circle of rotation for cutter 14, extending through point 50, and (ii) the surface axis 47 of cutter 14.

As shown in FIG. 1, the rotation of cutter 12 about its side rake axis 52 is opposite to the rotation of cutter 14 about its side rake axis 52. For cutter 12, its surface axis 43 is rotated about the side rake axis 52 toward the bit axis 18, and its cutter face defines a cutting surface that is angled toward the gauge circle 10 of the bit. For cutter 14, its surface axis 47 is rotated about the side rake axis 52 away from the axis of rotation 18 and towards the gauge circle 10 of the bit, and its cutter face defines a cutting surface angled toward the bit axis 18. Accordingly, cutters 12 and 14 face toward each other and have side rakes that converge on one another.

As discussed above, the three cutters shown in FIG. 2 and cutter 19 have no side rake, or a zero degree side rake angle. As convention, rotation of the cutter from the zero degree side rake position to angle the cutter face towards gauge 20 of the bit establishes a positive side rake angle. Rotation of the cutter from the zero degree side rake position to angle the cutter face towards the bit axis 18 of the bit establishes a negative side rake angle. Accordingly, cutter 12 has a positive side rake angle, and cutter 14 has a negative side rake angle.

c. Back Rake Angle

The "back rake axis" for a given cutter is defined as the tangent of the cutting profile curve 42 at the point 51 where the projection of the cutter touches the bit cutting profile curve 42. The back rake axis 58 for a given cutter is thus orthogonal to both the cutter axis and the cutter's side rake axis 52. Line 58 for cutters 46 and 48 in FIG. 2 represents each cutter's back rake axis. The back rake axis 58 for cutter 44 is not labeled because its back rake axis 58 and the cutting profile curve 42 substantially overlap. Rotation (not indicated in FIG. 2) of the cutter around its back rake axis 58 establishes its "back rake angle," which is defined as the angle between (1) a line normal to the cutting profile at the point (e.g., point 51) where the projection of the cutter diameter touches the bit cutting profile (e.g., curve 42) and (2) a line in the plane of the cutting surface extending through the center point 50 of the cutting surface.

Figure 3B:
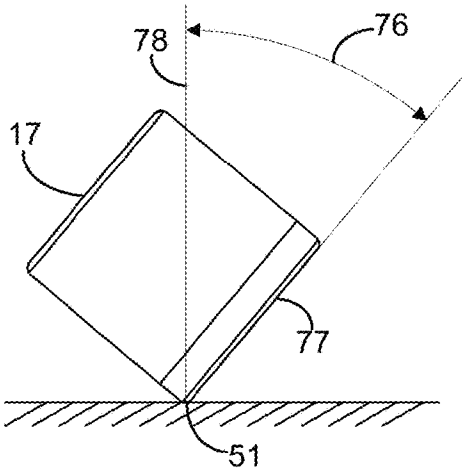
FIG. 3B shows a schematic illustration of another cutter having a positive back rake angle, in accordance with some embodiments of the present invention.
Figure 3A:
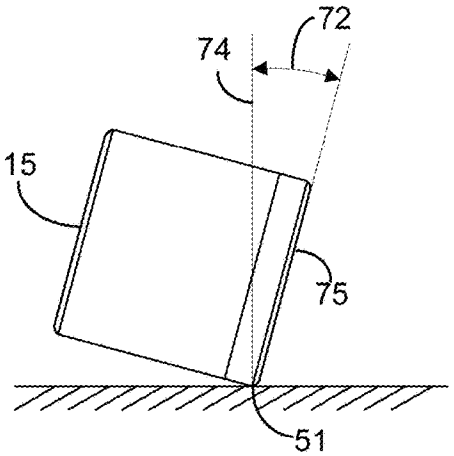
FIG. 3A shows a schematic illustration of a cutter having a positive back rake angle, in accordance with some embodiments of the present invention.
Figure 4C:
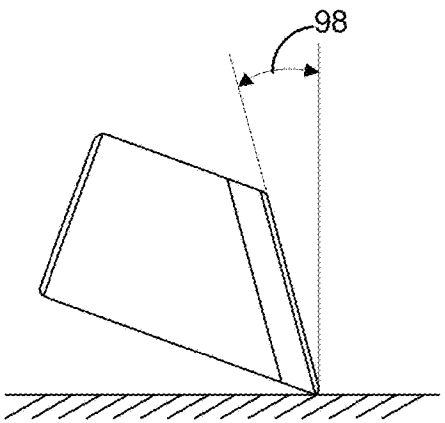
FIG. 4C shows a schematic illustration of a cutter having a negative back rake angle, in accordance with some embodiments of the present invention.

Cutters 15 and 17 in FIG. 1 are shown to have different amounts or degrees of back rake, and are also shown in FIGS. 3A and 3B, respectively. In the case of cutter 15, the back rake angle 72 is defined between line 74, which is normal to the cutting profile (or formation surface) at contact point 51, and a line in the plane of the cutting surface 75 extending through the center point thereof. In the case of cutter 17, the back rake angle 76 is defined between line 78, which is normal to the cutting profile (or formation surface) at contact point 51 and a line in the plane of cutting surface 77 extending through the center point thereof. In FIGS. 3A and 3B, the contact point 51 and each cutter's back rake axis 58 overlap.

When the cutter face or surface is aligned with the vector normal to the cutting profile, that cutter is said to have zero back rake or a "zero degree" back rake angle. The three cutters shown in FIG. 2 and cutter 19 shown in FIG. 1 have zero degree back rake angles. When the rotation of the cutter about its back rake axis 58 angles the cutter face towards the formation leading the cutter along the direction of bit rotation, the rotation about the back rake axis 58 establishes a positive back rake angle for that cutter. When the rotation of the cutter about its back rake axis 58 angles the cutter face away from the formation leading the cutter along the direction of bit rotation, the rotation about the back rake axis 58 is said to have a negative back rake angle for that cutter.

Both the rotation of cutter 15 and the rotation of cutter 17 about their respective back rake axes 58 angle the respective cutting surfaces 75 and 77 forward along the direction of bit rotation toward the formation. Thus, cutters 15 and 17 each have a positive back rake angle. Cutter 17 has a greater back rake angle 76 than back rake angle 72 of cutter 15. Comparatively speaking, a cutter having a lesser positive back rake angle is said to have a more aggressive back rake angle than a cutter having a greater positive back rake angle. In a pair of cutters that have different positive back rake angles, the cutter with the lesser back rake angle may be referred to as the aggressive cutter, and the cutter with the greater back rake angle may be referred to as the passive cutter, relative to one another.

Figure 4B:
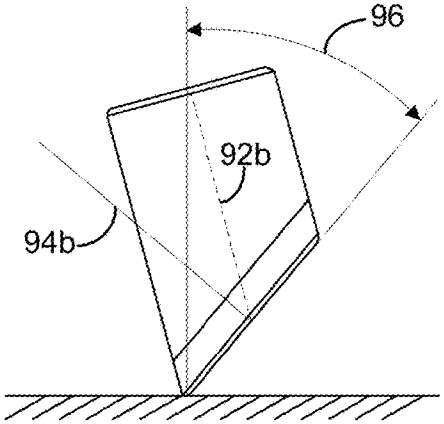
FIGS. 4A and 4B show schematic illustrations of two different cutters having a common positive back rake angle, in accordance with some embodiments of the present invention.
Figure 4A:
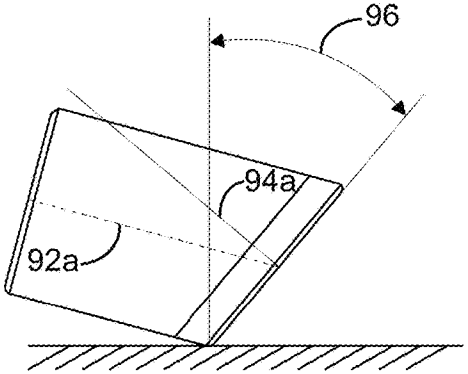

In the embodiments shown in FIGS. 3A and 3B, the surface axis aligns with the cutter axis. In some embodiments, as discussed above, the cutter may not be longitudinally symmetrical, resulting in a cutter axis that is slanted or angled relative to the cutting surface. FIGS. 4A and 4B show cutters having cutter axes 92*a* and 92*b* of their respective cutters that do not align with the respective surface axes 94*a* and 94*b* of the cutter surfaces. Moreover, cutter axes 92*a* and 92*b* are slanted or angled relative to their respective cutting surfaces. The same back rake angle 96, however, may be achieved by mounting the cutters on the bit body at different mounting angles. Having the cutter axis slanted or angled with respect to the cutting surface may facilitate establishing a negative back rake angle, such as negative back rake angle 98 shown in FIG. 4C.

d. Cone, Nose, Shoulder, and Gauge

Referring back to FIG. 2, angle 56 between the side rack axis 52 and line 54, which crosses the cutter's cutter axis and is parallel to the bit axis 18, defines the "cutting profile angle," as measured in a clock-wise direction. Line 60 represents the zero angle for the cutting profile. Section 62 of the cutting profile corresponds to the cone of a PDC bit. The profile angles in this section are somewhere between 270 degrees and 360 (or zero) degrees. The profile angles increase toward 360 degrees starting from the bit axis 18 and moving toward the zero degree profile angle at line 60. The bit's nose corresponds generally to section 63 of the cutting profile, and is disposed radially outward from the cone section. In the nose section, the profile angles are close to zero degrees. Portion 64 of the profile corresponds to the bit's shoulder section, and is disposed radially outward from the nose section. The profile angles increase quickly in this section until they reach 90 degrees. Section 66 of the cutting profile corresponds to the bit's longitudinally extending gauge section. The cutting profile angle in the gauge section is approximately 90 degrees.

III. Drill Bit with Cutters Having Alternating Back and/or Side Rake Angles

Figure 5:
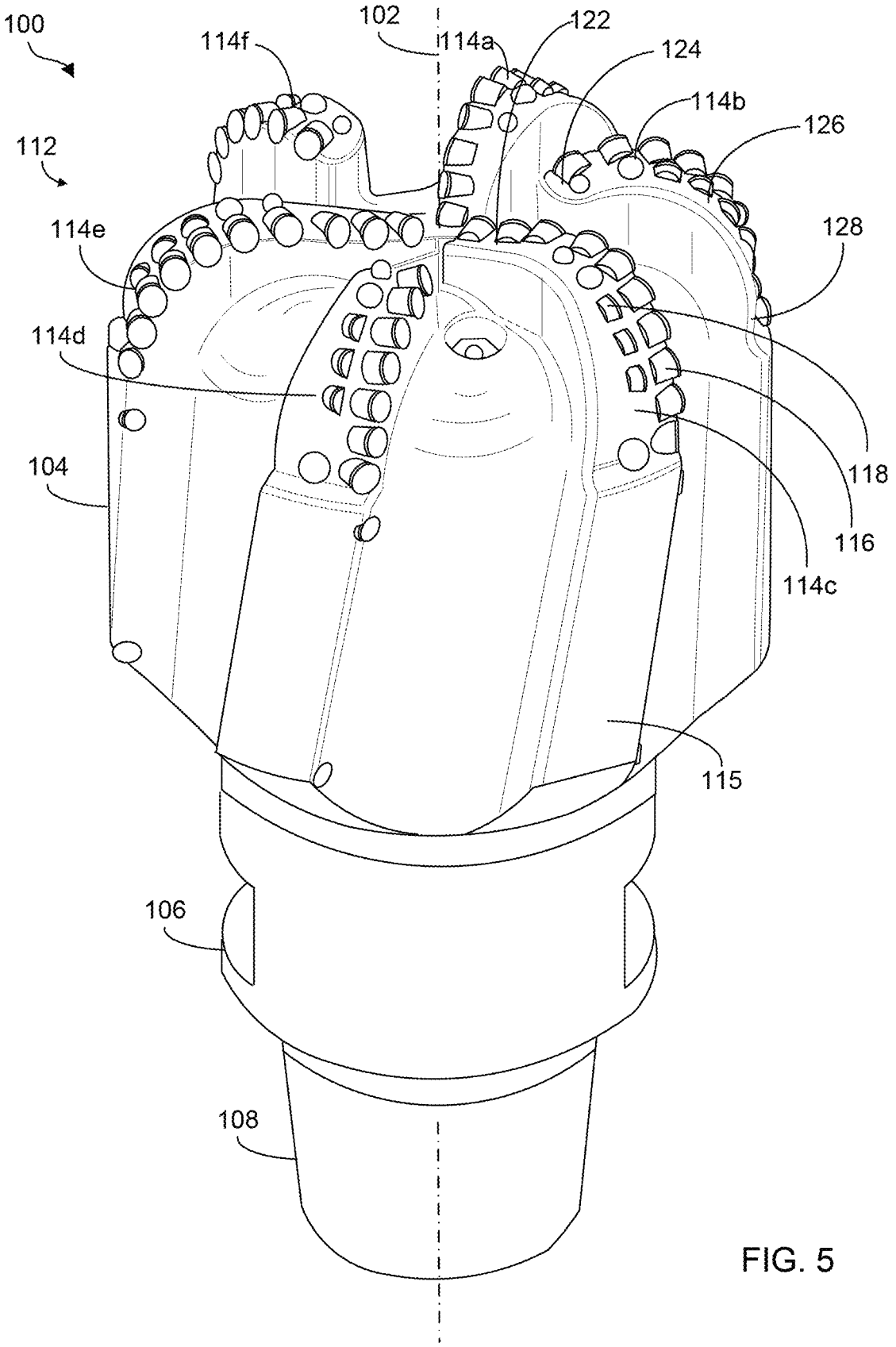
FIG. 5 shows a side perspective view of a drill bit in accordance with some embodiments of the present invention.
Figure 6:
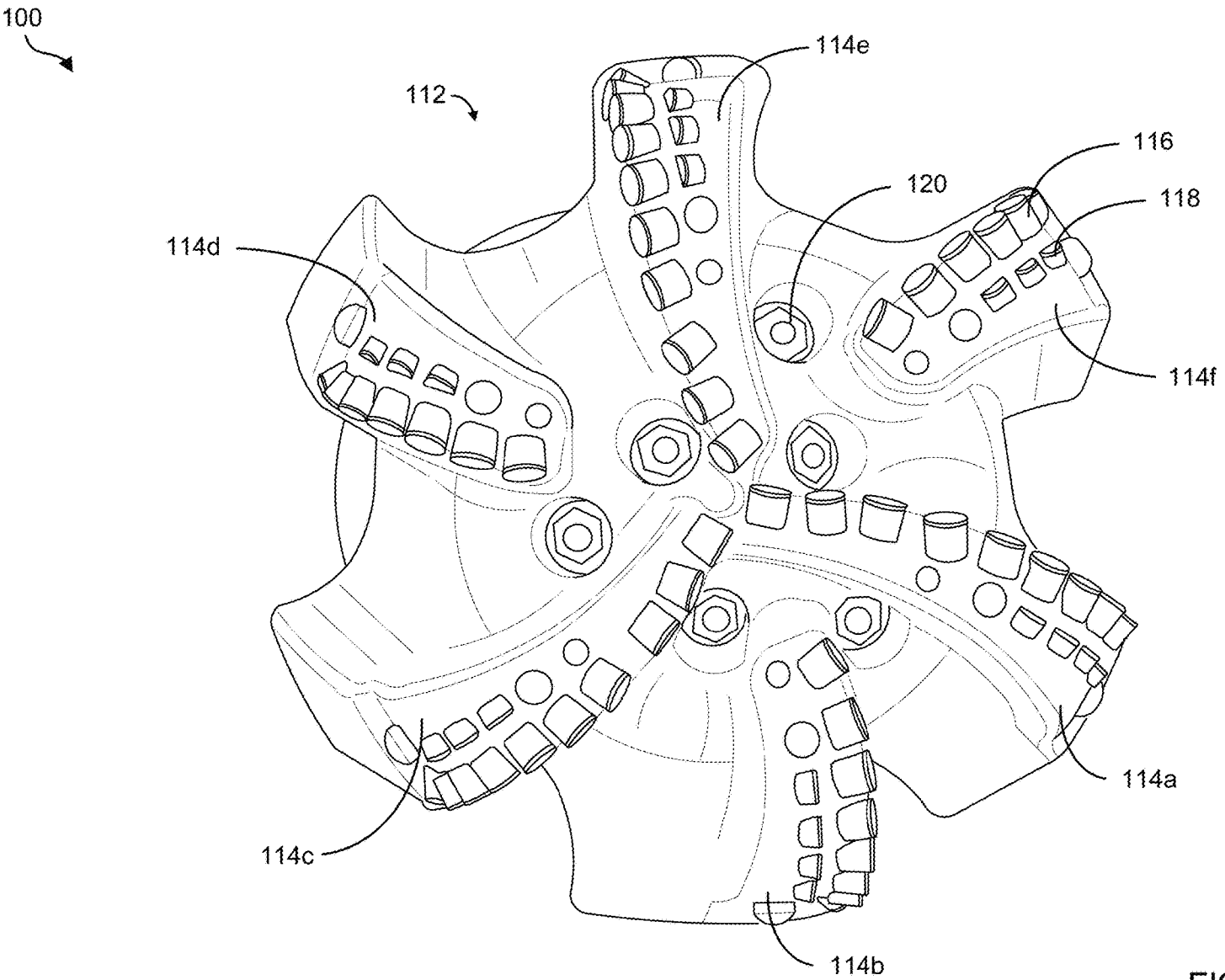
FIG. 6 shows a face view of the drill bit of FIG. 5, in accordance with some embodiments of the present invention.

Referring to FIGS. 5 and 6, there are shown some embodiments of a drill bit 100, and more specifically, a rotary drag bit with PDC cutters. FIGS. 5 and 6 illustrate the side perspective view and face view of the drill bit 100, respectively. The drill bit 100 is designed to be rotated around its central bit axis 102 as shown in FIG. 5.

In some embodiments, drill bit 100 may include, but is not limited to, a bit body 104 connected to a shank 106 and a tapered threaded coupling 108 for connecting the bit to a drill string. The exterior surface of bit body 104 that is intended to face generally in the direction of boring is referred to as the face of drill bit 100 and is generally designated by reference number 112.

Disposed on the bit face 112 are a plurality of raised blades 114*a*-114*f* separated by channels or "junk slots" between blades 114*a*-114*f* Each blade 114 extends generally in a radial direction, outwardly to the periphery of face 112 of drill bit 100. In this example, there are six blades 114 spaced around the bit axis 102, and each blade 114 sweeps or curves backwardly relative to the direction of rotation. Blades 114*a*, 114*c*, and 114*e* in this particular example have segments or sections located along the cone 122 of the bit body 104. All six blades 114 in this example either start or have a segment or section on the nose 124 of the bit body 104, in which the angle of the cutting profile is close to zero, a segment along the shoulder 126 of the bit body 104, which is characterized by increasing profile angles, and a segment on the gauge 128. Bit body 104 includes a plurality of gauge pads 115 located at the end of each of the blades 114. In various embodiments, bit 100 could have a different numbers of blades 114, blade lengths and/or locations.

Disposed on each blade 114 is a row of discrete primary cutting elements, or primary cutters 116, that collectively are part of the bits primary cutting profiles. Also located on each of the blades 114 are a row or a set of back-up cutters 118 that often, collectively, form a second cutting profile for the bit 100. In this example, all of the cutters 116 and 118 are PDC cutters, with a wear or cutting surface made of super hard, polycrystalline diamond, or the like, supported by a substrate that forms a mounting stud for placement in each pocket formed in the blade 114. Nozzles 120 are positioned in the body to direct drilling fluid along the cutting blades 114 to assist with evacuation of rock cuttings or chips and to cool cutters 116 and 118.

In some embodiments, at least some of the primary cutters 116 may have non-zero back rake angles and/or non-zero side rake angles. In some embodiments, at least some of the back-up cutters 118 may also have non-zero back rake angles and/or non-zero side rake angles. In some embodiments, only the primary cutters 116 may have non-zero back rake angles and/or non-zero side rake angles, and none of the back-up cutters 118 may have non-zero back rake angles and/or non-zero side rake angles, or vice versa. The following discussion on back rake angle configuration and side rake angle configuration of the cutters will be made with reference to primary cutters 116. It should be understood that back-up cutters 118 may have the same or similar back rake angle configuration and/or side rake angle configuration.

a. Back Rake Arrangement of Cutters

Referring to FIGS. 5 and 6, at least some of the primary cutters 116 on one or more of the blades 114 may have positive back rake angles. Further, at least some of the primary cutters 116 on the same blade 114 may have positive back rake angles arranged in an alternating manner.

Specifically, one or more blades 114 may include a first set of primary cutters 116 and a second set of primary cutters 116 arranged in an alternating manner. The first set of primary cutters 116 may include one or more primary cutters 116, and the second set of primary cutters 116 may include one or more primary cutters 116. Each of the first set of primary cutters 116 may have a positive back rake angle, and each of the second set of primary cutters 116 may have a positive back rake angle. The positive back rake angle of each primary cutter 116 of the first set may be greater than the positive back rake angle of an adjacent primary cutter 116 of the second set, although the positive back rake angle of a primary cutter 116 of the first set may be the same as or less than the positive back rake angle of a non-adjacent primary cutter 116 of the second set. Conversely, the positive back rake angle of each of primary cutter 116 of the second set may be less than the positive back rake angle of an adjacent primary cutter 116 of the first set, although the positive back rake angle of a primary cutter 116 of the second set may be the same as or greater than the positive back rake angle of a non-adjacent primary cutter 116 of the first set. With this configuration, at least the first set of primary cutters 116 and the second set of primary cutters 116 on the same blade 114 may have alternating positive back rake angles.

In some embodiments, one or more primary cutters 116 of the second set may include zero back rake angles. Consequently, in some embodiments, primary cutters 116 having alternating positive back rake angles may include only primary cutter 116 that have positive, non-zero back rake angles, while in some embodiments, primary cutters 116 having alternating positive back rake angles may also include one or more primary cutters 116 that have zero back rake angles. In the latter embodiments, those cutters may also be said to have alternating non-negative back rake angles.

The first set of primary cutters 116 may each have a positive back rake angle within a first predetermined range, within the first predetermined range±3°, within the first predetermined range±5°, or within the first predetermined range±9° in various embodiments. In some aspects, the first predetermined range may be from 10 to 30°, from 15 to 25°, or from 18 to 22°. The average of the first predetermined range may be 20±10°, 20±9°, 20±7°, 20±5°, 20±3°, 20±1°, or approximately 20°.

The second set of primary cutters 116 may each have a positive back rake angle within a second predetermined range, within the second predetermined range±3°, within the second predetermined range±5°, or within the second predetermined range±9° in various embodiments. In some aspects, the second predetermined range may be from 0 to 20°, from 5 to 15°, or from 8 to 12°. The average of the second predetermined range may be 10±10°, 10±9°, 10±7°, 10±5°, 10±3°, 10±1°, or approximately 10°.

The difference between at least one primary cutter 116 of the first set and an adjacent primary cutter 116 of the second set may be less than 20°, less than 15°, less than 10°, or less than 5°, less than 3°, or less than 1° in various embodiments. In some embodiments, the difference may be 20° or greater than 20°. In some embodiments, the difference between at least a majority of back rake angles on adjacent primary cutters 116 of the first and second sets may be less than 20°, less than 15°, less than 10°, or less than 5°. The difference between the average of the positive back rake angles of the first set of primary cutters 116 and the average of the positive back rake angles of the second set of primary cutters 116 may be from 5 to 20°, from 5 to 15°, from 5 to 10°, from 10 to 20°, or from 15 to 20° in various embodiments.

In addition to the primary cutters 116 having alternating positive back rake angles, one or more blades 114 may also include one or more primary cutters 116 that may have positive back rake angle(s), negative back rake angle(s), or zero back rake angle(s). In some embodiments, the additional one or more primary cutters 116 may be disposed radially inward from the first and second sets of primary cutters 116. In some embodiments, the additional one or more primary cutters 116 may be disposed radially outward from the first and second sets of primary cutters 116. In some embodiments, one or more of the additional primary cutters 116 may be disposed among or between the first and second sets of primary cutters 116. In some embodiments, one or more blades 114 or all of the blades 114 may include no primary cutters 116 having negative or zero back rake angles. All of the primary cutters 116 may have positive back rake angles.

FIGS. 9A-9F show the back rake angles of the primary cutters 116 on blades 114*a*, 114*b*, 114*c*, 114*d*, 114*e*, and 114*f*, respectively. FIGS. 10A-10F show the side rake angles of the primary cutters 116 on blades 114*a*, 114*b*, 114*c*, 114*d*, 114*e*, and 114*f*, respectively.

As illustrated in FIGS. 5 and 6 and plotted in graphs of FIGS. 9A-9F, on each blade 114, at least some of the primary cutters 116 had alternating positive back rake angles. Depending on the application, the back-up cutters 118 may or may not have alternating positive back rake angles.

The primary cutters 116 having alternating positive back rake angles may be disposed on at least one of the cone section, the nose section, the shoulder section or the gauge region. For example, the primary cutters 116 that have alternating positive back rake angles on the blades 114*a* and 114*e* may be disposed on the cone section, the nose section, and the shoulder section. The primary cutters 116 having alternating positive back rake angles on the blades 114*b* and 114*c* may be disposed on the cone section, the nose section, the shoulder section, and all the way on the gauge. The primary cutters 116 having alternating positive back rake angles on the blades 114*d* and 114*f* may be disposed only on the nose and shoulder sections.

A drill bit having alternating positive back rake angles, or alternating passive and aggressive back rake angles, may have improved dull grading (e.g., 0-1) as compared to drill bits without alternating aggressive and passive back rake angles, which may have dull grading of from 2 to 8 or 1 to 4 resulted from the same testing/drilling conditions.

"Dull grading" indicates the amount of wear of a cutting structure. Dull grading is reported by use of an eight-increment wear scale in which "0" represents no wear and "8" indicates that no usable cutting surface remains. For PDC cutters, the amount of wear is measured across the diamond table of a cutter. For example, if wear occurs across ⅛ of the diamond table, a dull grading of 1 is reported for that cutter; if wear occurs across ⅜ of the diamond table, a dull grading of 2 is reported for that cutter; and so forth. For drill bits, two values of dull grading are generally reported: an average dull grading (rounded to the nearest integer) for the inner cutters of the drill bit and an average dull grading (rounded to the nearest integer) for the outer cutters of the drill bit. The inner cutters are cutters disposed within the inner ⅔ of the bit diameter, and typically comprise cutters inside the nose of the drill bit. The outer cutters are cutters disposed within the outer ⅓ of the bit diameter, and typically comprise cutters outside the nose of the drill bit.

In some embodiments, by arranging the cutters to have alternating positive back rake angles, the average dull grading for the inner and/or outer cutters may be reduced by at least 3 wear scale, as compared to drill bits without alternating positive back rake angles operating under the same testing/drilling conditions. For example, while a dull grading of 4 or greater, up to 8, may be observed for drill bits without alternating positive back rake angles, a dull grading of only 0 or 1 may be observed for drill bits with alternating positive back rake angles operating under the same testing/drilling conditions.

Using the alternating positive back rake angle configurations described herein may also result in smoother torque signature, less axial vibration damage, and less lateral vibration damage than when using a drill bit without the alternating positive back rake angle configurations.

FIGS. 7A-7K are graphs showing some non-limiting examples of alternating back rake configurations for fixed cutters on a drill bit, such as the primary cutters 116 and/or the back-up cutters 118 of the drill bit 100. The horizontal axis represents successive radial positions of adjacent cutters of a blade within a bit's cutting profile. A position along the horizontal axis that is closer to the origin represents a cutter position closer to the axis of rotation (bit axis) of the drill bit and more distant from the gauge of the body of the drill bit. A position along the horizontal axis that is further away from the origin represents a cutter position more distant from the axis of rotation (bit axis) and closer to the gauge of the body. The graphs are intended to illustrate the relative positions of the cutters, i.e., closer to or further away from the axis of rotation, and should not be interpreted to limit or set a particular position for each cutter on the blade or within a cutting profile. Thus, the configurations or patterns illustrated can be used in any section of the blade or any section of the cutting profile. The vertical axis indicates the back rake angle of the cutters. The portion of the vertical axis above the horizontal axis indicates positive back rake angles, and the portion of the vertical axis below the horizontal axis indicates negative back rake angles. The vertical bar crossing each data point indicates a range of back rake angles that the associated cutter may have.

The following discussion of FIGS. 7A-7K refers to the illustrated back rake angles as values of the back rake angle, but it should not be interpreted to limit or set a particular back rake angle to be a single value. Rather, the value of a back rake angle discussed may encompass a range of values. Depending on the embodiments, the difference between the maximum back rake angle and the minimum back rake angle of a range may be 20°, 15°, 10°, or 5°.

Figure 7A:
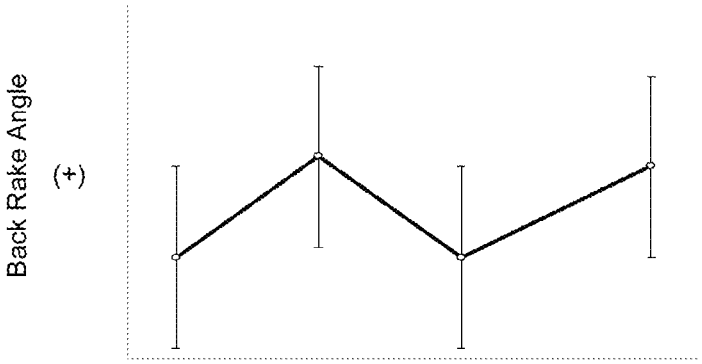
FIGS. 7A-7K are graphs showing exemplary back rake configurations for cutters on a drill bit, in accordance with some embodiments of the present invention.

FIG. 7A shows a configuration in which the back rake angles of adjacent cutters alternate between a first positive back rake angle value and a second positive back rake angle value. For example, the first and third cutters may have a first back rake angle, and the second and fourth cutters may have a second back rake angle greater than the first back rake angle. As discussed above regarding the back rake angle values, the first and third cutters may or may not have exactly the same back rake angle but may have back rake angles within a first common range. Similarly, the second and fourth cutters may or may not have exactly the same back rake angle but may have back rake angles within a second common range. Although back rake angles of four cutters are shown, similar back rake angle configuration may be used for three cutters or more than four cutters. In the case of three cutters, the middle cutter may have a back rake angle greater than the adjacent cutters in some embodiments, and may have a back rake angle less than the adjacent cutters in other embodiments. In the configuration shown in FIG. 7A, the back rake angle of every other cutter may be roughly the same or within the same range. Additionally, not all cutters in the same row need have alternating back rake angles. For example, in a row of eight cutters, four cutters may have alternating back rake angles and the remaining four cutters may have substantially the same back rake angles.

Figure 7B:
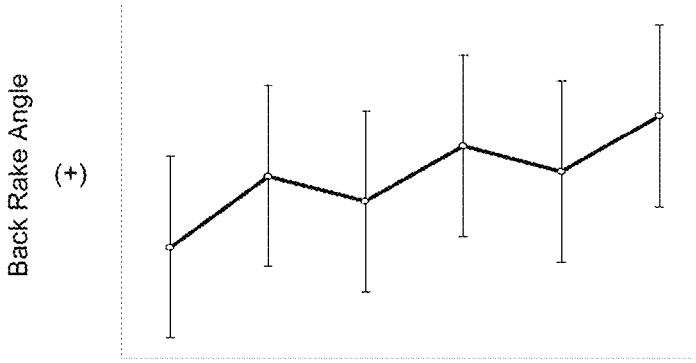

FIG. 7B shows another configuration of alternating positive back rake angles. The configuration shown in FIG. 7B differs from the configuration shown in FIG. 7A in that the back rake angle of every other cutter may gradually increase as the cutter is disposed further away from the bit axis, although the alternating arrangement of the back rake angles between adjacent cutters may still be observed. Accordingly, in some embodiments, a cutter disposed closer to the gauge may have a smaller back rake angle as compared to its adjacent cutters, but may nonetheless have a greater back rake angle as compared to a cutter disposed closer to the bit axis. For example, in the configuration shown in FIG. 7B, the fifth cutter from the bit axis may have a smaller back rake angle as compared to the fourth and sixth cutters, but may have a greater back rake angle as compared to the first, second, and/or third cutters.

Figure 7C:
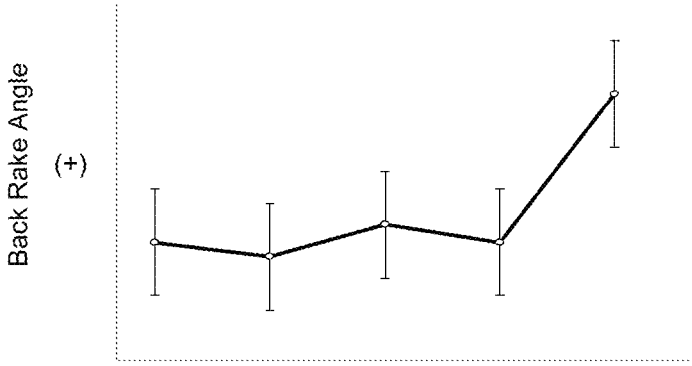

FIG. 7C shows another configuration of alternating positive back rake angles. As compared to the configuration shown in FIG. 7B, in addition to gradually increasing back rake angles in a direction away from the bit axis and toward the gauge of the bit body, the difference between adjacent cutters may also increase.

Figure 7D:
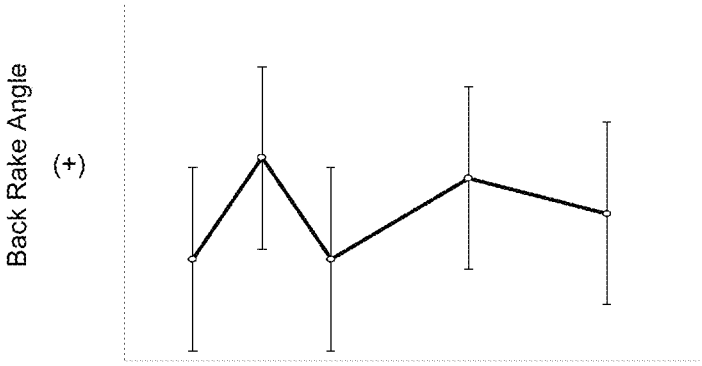

FIG. 7D shows another configuration of alternating positive back rake angles. In the configuration shown in FIG. 7D, the back rake angles alternate or oscillate about a back rake angle value. In some embodiments, the back rake angles may alternate or oscillate about the average value of the back rake angles of the cutters having alternating positive back rake angles. Further, in the configuration shown in FIG. 7D, the difference between adjacent cutters may gradually decrease as the cutters are disposed further away from the bit axis.

Figure 7E:
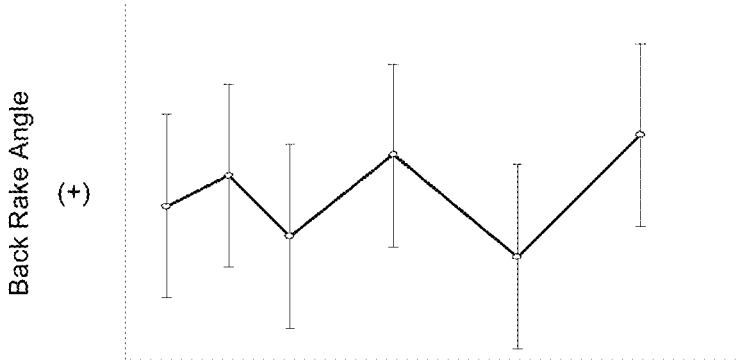

FIG. 7E shows another configuration of alternating positive back rake angles. The configuration shown in FIG. 7E is similar to the configuration shown in FIG. 7D except that the difference between adjacent cutters may gradually increase as the cutters are disposed further away from the bit axis.

Figure 7F:
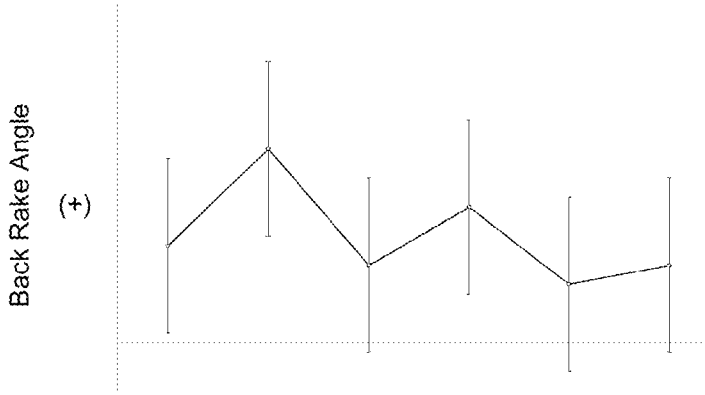

FIG. 7F shows another configuration of alternating positive back rake angles. In this configuration, the back rake angle of every other cutter may gradually decrease as the cutters are disposed further away from the bit axis, although the alternating arrangement of the back rake angles between adjacent cutters may still be observed. In some embodiments, as the back rake angles of the further outwardly disposed cutters decrease, one or more cutters may even have negative back rake angles, as indicated by some of the vertical bars extending below the horizontal axis of the graph. Further, in some embodiments, the difference between the back rake angles of adjacent cutters may also decrease as the cutters are disposed further radially outward, although in some embodiments, the difference between the back rake angles of adjacent cutters may increase as the cutters are disposed further radially outward.

Figure 7G:
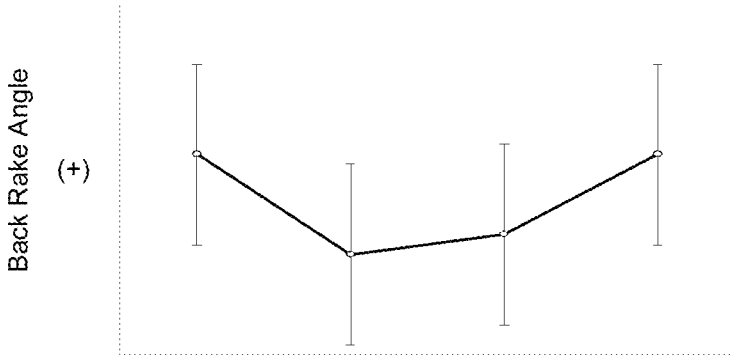
Figure 7H:
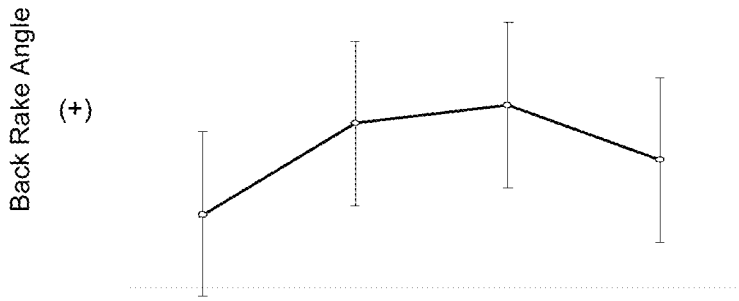

FIGS. 7G and 7H show additional configurations of positive back rake angles. The configurations shown in FIGS. 7G and 7H may be similar to the configurations shown in FIGS. 7A to 7F in that an increase in back rake angles between adjacent cutters and a decrease in back rake angles between adjacent cutters may still be observed among the cutters on the same blade. The configurations shown in FIGS. 7G and 7H may differ from the configurations shown in FIGS. 7A to 7F in that the increase or the decrease may not immediately follow each other. In some embodiments, the back rake angles may continue to increase or decrease. For example, in the configuration shown in FIG. 7G, the back rake angle of the third cutter is increased from the back rake angle of the second cutter, while the back rake angle of the fourth cutter is further increased from the back rake angle of the third cutter. In the configuration shown in FIG. 7H, the back rake angle of the second cutter is increased from the back rake angle of the first cutter, while the back rake angle of the third cutter is further increased from the back rake angle of the second cutter.

Figure 7I:
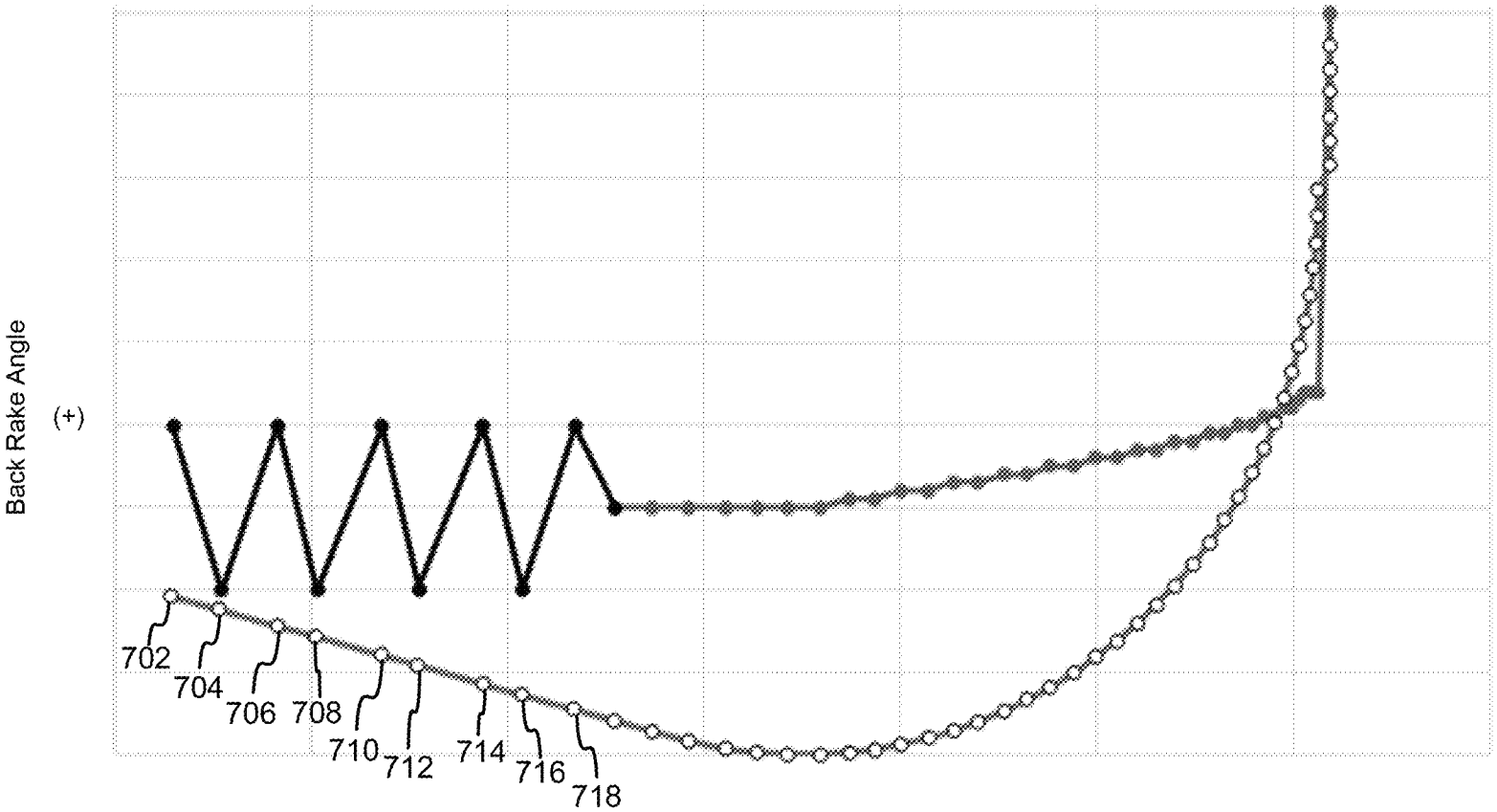
Figure 7J:
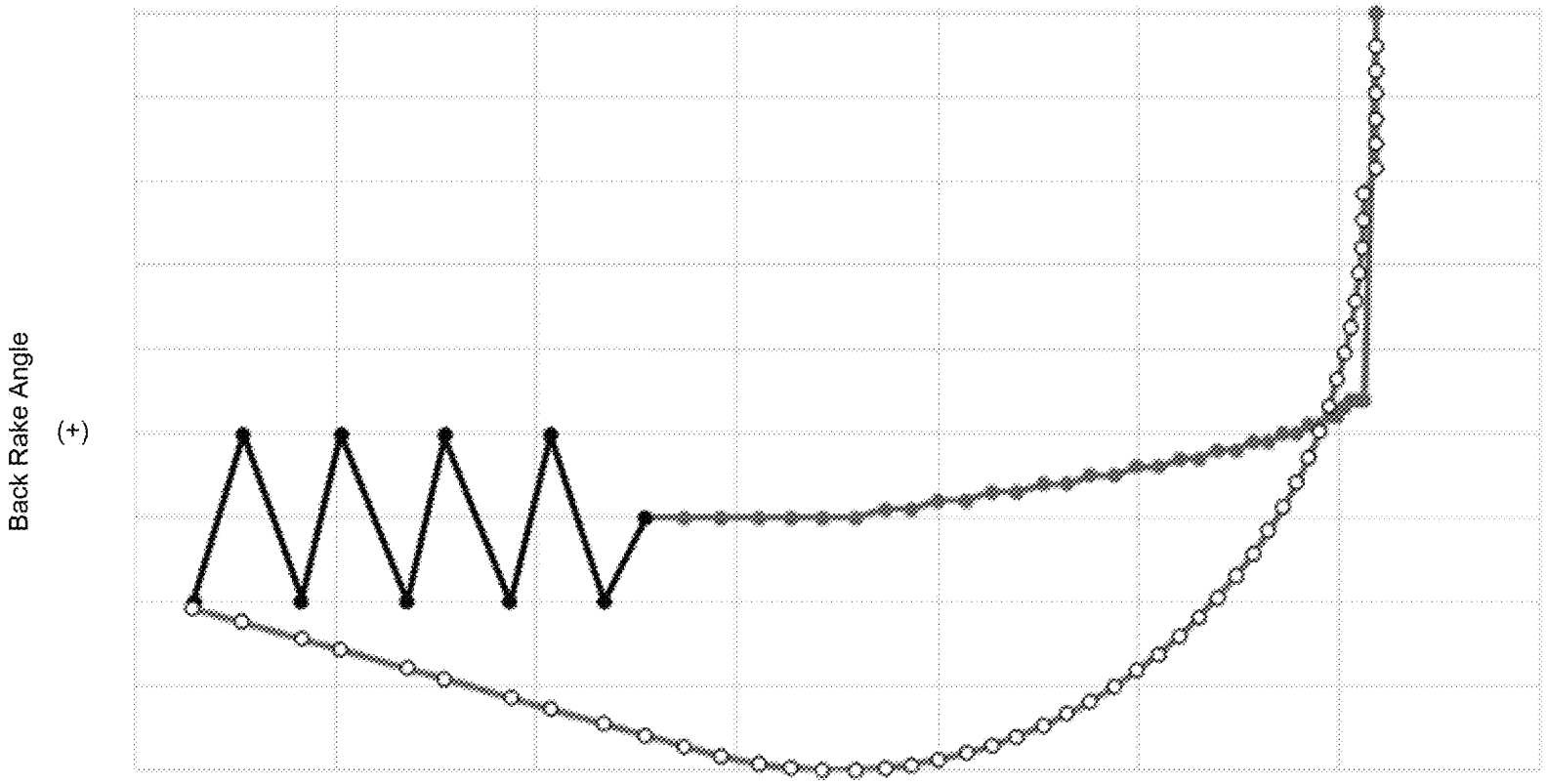
Figure 7K:
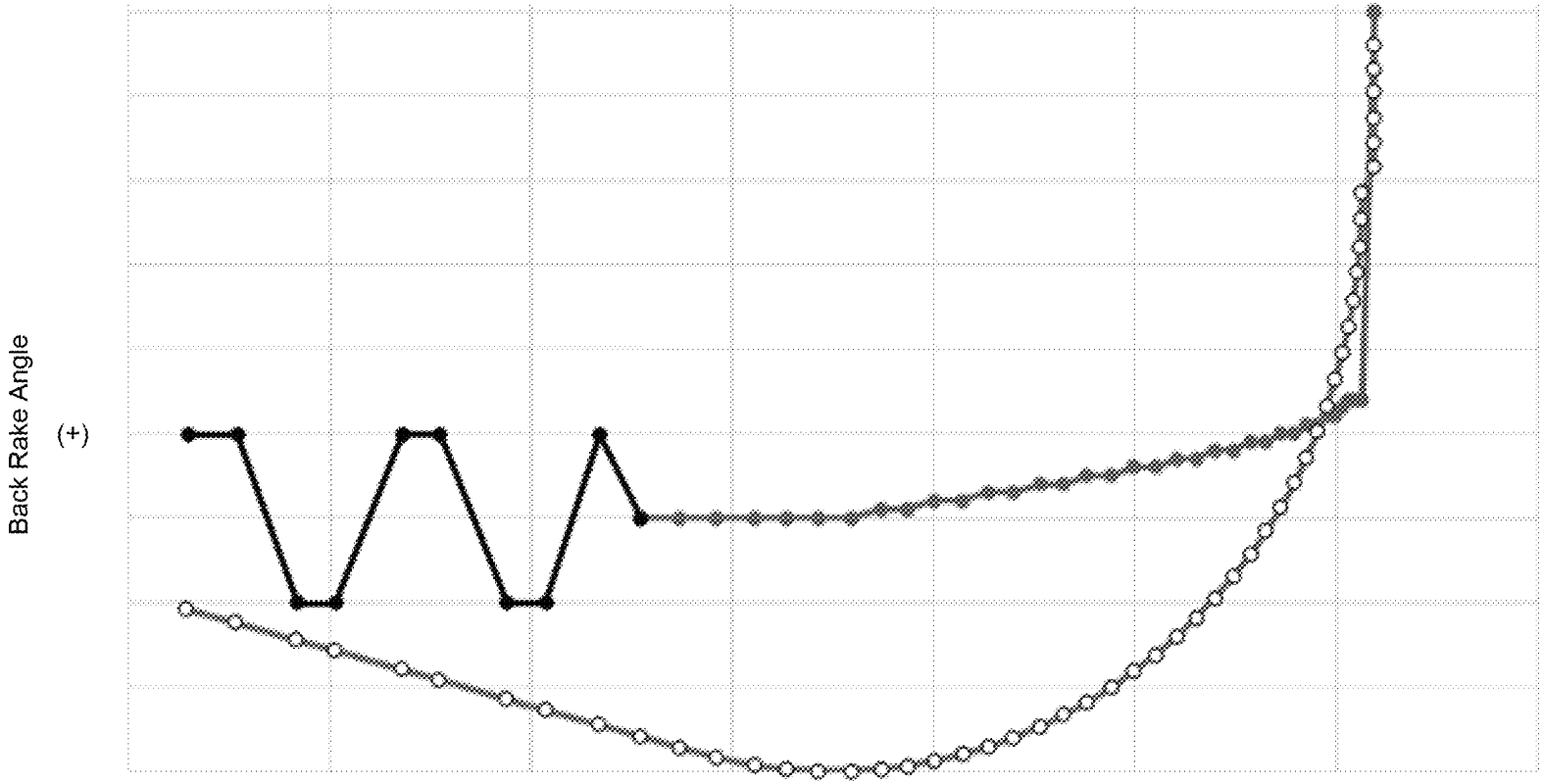

As already mentioned above, the configurations or patterns illustrated in FIGS. 7A-7H can be used in any section of the blade or any section of the cutting profile. FIGS. 7I-7K show additional configurations of positive back rake angles. In addition to the back rake angles of the cutters (represented by solid dots in FIGS. 7I-7K), FIGS. 7I-7K also show the cutting profile defined by the cutters (represented by hollow dots or circles in FIGS. 7I-7K). Thus, in FIGS. 7I-7K, for each radial position that is occupied by a cutter, the solid dot represents the back rake angle value of the cutter at that radial position, and the hollow dot or circle represents that cutter's relative vertical position or height with respect to other cutters. The cutters defining each of the cutting profiles in FIGS. 7I-7K may all be primary cutters in some embodiments, may all be back-up cutters in some embodiments, or may be a combination of primary and/or back-up cutters in some embodiments. Some of the cutters may have alternating positive back rake angles. Some of the cutters may have positive back rake angles that may not be alternating.

It should be noted that the configurations or patterns illustrated in FIGS. 7I-7K are for illustrative purposes only and are not intended to be limiting. Although the alternating back rake arrangements are more prominently demonstrated in the cone section of each cutting profile for illustrative purposes, the alternating back rake arrangements may be present along any of the cone, nose, shoulder, and/or gauge sections of the cutting profile. As the cutters are disposed further radially outward, the difference between adjacent cutters may gradually decrease or increase, depending on the application. Further, although three exemplary configurations are shown in FIGS. 7I-7K, additional configurations and patterns same as or similar to those discussed above with reference to FIGS. 7A-7H may be present along any portion of the cutting profile.

With reference to FIG. 7I, the back rake angles of adjacent cutters in at least a portion of the cone section may alternate between a first positive back rake angle value and a second positive back rake angle value that may be less than the first positive back rake angle value. The first positive back rake angle value may range from 10 to 30°, from 15 to 25°, or from 18 to 22°. The second positive back rake angle value may range from 0 to 20°, from 5 to 15°, or from 8 to 12°. Every other cutter that has the first positive back rake angle value may have a common positive back rake angle value in some embodiments or may have different positive back rake angle values in some embodiments. Similarly, every other cutter that has the second positive back rake angle value may have a common positive back rake angle value or different positive back rake angle values. The difference between the back rake angle values of adjacent cutters may be less than 20° in some embodiments, e.g., less than 15°, less than 10°, or less than 5°.

As discussed earlier, cutters that are adjacent to one another in a cutting profile are typically on different blades. Thus, the cutters in FIG. 7I that are adjacent to one another in the cutting profile and have alternating back rake arrangement may not be on the same blade, and may be disposed on different blades. For example, the first cutter 702 (i.e., the cutter at the radial position closest to the bit axis) may be disposed on a first blade, the second cutter 704 adjacent to and radially outward from the first cutter 702 may be disposed on a second blade, and the third cutter 706 adjacent to and radially outward from the second cutter 704 may be disposed on a third blade. The fourth cutter 708 and the seventh cutter 714 may also be disposed on the first blade, the fifth cutter 710 and the eighth cutter 716 may also be disposed on the second blade, and the sixth cutter 712 and the ninth cutter 718 may also be disposed on the third blade. Thus, in the example shown in FIG. 7I, every third cutter may be disposed on the same blade while adjacent cutters may be disposed on different blades. The first, second, and/or third blades may be adjacent to each other in some embodiments. In some embodiments, the first, second, and/or third blades may not be adjacent to each other. For example, referring back to FIGS. 5 and 6, the first, second, and third blades may be blade 114*a*, blade 114*c*, and blade 114*e*, respectively, and thus may not be adjacent to each other.

In the example shown in FIG. 7I, not only do some of the cutters along the cutting profile have alternating positive back rake angles, at least some of the cutters within a single blade may also have alternating back rake angles. For example, the first, fourth, and seventh cutters 702, 708, 714 on the first blade may be arranged in a row with one adjacent to the next and have back rake angle values alternating between the first and second positive back rake angle values. Similarly, the second, fifth, and eighth cutters 704, 710, 716 on the second blade may be arranged in a row with one adjacent to the next and have back rake angles alternating between the first and second positive back rake angle values, and the third, sixth, and ninth cutters 706, 712, 718 on the third blade may be arranged in a row with one adjacent to the next and have back rake angles alternating between the first and second positive back rake angle values.

FIG. 7J shows another configuration of alternating positive back rake angles. The arrangement shown in FIG. 7J is similar to the arrangement shown in FIG. 7I, except that the cutters having the first positive back rake angle value in FIG. 7I have the second positive back rake angle value in FIG. 7J, and the cutters having the second positive back rake angle value in FIG. 7I have the first positive back rake angle value. Further, similar to the arrangement shown in FIG. 7I, every third cutter of the cutters in the cone section shown in FIG. 7J having alternating back rake angles may be disposed on the same blade. Thus, not only may the adjacent cutters along the cutting profile of FIG. 7J have alternating positive back rake angles, the adjacent cutters on at least some of the blades may also have alternating positive back rake angles.

FIG. 7K shows another configuration of alternating positive back rake angles. In this example, some pairs of adjacent cutters may have positive back rake angles of a first positive back rake angle value, and some pairs of adjacent cutters may have positive back rake angles of a second positive back rake angle value. The first positive back rake angle value may range from 10 to 30°, from 15 to 25°, or from 18 to 22°. The second positive back rake angle value may range from 0 to 20°, from 5 to 15°, or from 8 to 12°. Within each pair, the two adjacent cutters may have the same or different, but similar positive back rake angles. In the example shown in FIG. 7K, every other pair of cutters may have a common or similar positive back rake angles. Thus, adjacent pairs of cutters in the example of FIG. 7K have alternating back rake angles. Although pairs of the cutters are shown to have common or similar positive back rake angles in the example of FIG. 7K, more than two, such as three, four, five, or more, adjacent cutters may have a common or similar back rake angles and thus form a group or set of adjacent cutters having a common or similar back rake angles. Further, adjacent or consecutive groups or sets may have alternating back rack angles, and the number of cutters in each group may be the same or different from each other.

As already mentioned above, the various cutter configurations or patterns described herein may be implemented in any of the cone section, the nose section, the shoulder section, and/or the gauge section. The cutters having any of the cutter configurations described herein or a variation or a combination thereof may be disposed on a single or multiple blades. In some embodiments, the back rake angles of the cutters may alternate from blade to blade. For example, the cutters disposed in one or more of the cone, nose, shoulder, and/or gauge sections of a first blade may all have positive back rake angles within a first range, such as from 10 to 30°, from 15 to 25°, or from 18 to 22°. The cutters disposed in one or more of the cone, nose, shoulder, and/or gauge sections of a second blade may all have positive back rake angles within a second range, e.g., from 0 to 20°, from 5 to 15°, or from 8 to 12°. The first blade and the second blade may be adjacent to each other in some embodiments, or may be separated from each other by another blade in some embodiments.

In some embodiments, the drill bit may include a first set of blades and a second set of blades. The cutters in one or more of the cone, nose, shoulder, and/or gauge sections of the first set of blades may all have positive back rake angles within the first range. The cutters in one or more of the cone, nose, shoulder, and/or gauge sections of the second set of blades may all have positive back rake angles within the second range. The first set of blades and the second set of blades may be arranged in any manner. In some embodiments, the first set of blades and the second set of blades may be arranged in an alternating manner. In some embodiments, two or more blades of the first set of blades may be arranged in an adjacent manner. In some embodiments, two or more blades of the second set of blades may be arranged in an adjacent manner. In some embodiments, the adjacent two or more blades of the first set and the adjacent two or more blades of the second set may be arranged in a consecutive manner.

The cutters having any of the cutter configurations described above or a variation or a combination thereof may be disposed on one or more blades 114 and may be disposed on any of the cone section, the nose section, the shoulder section, and/or the gauge section. In some aspects, especially when drilling through a transitional formation, the cutters having alternating back rakes may be disposed on the nose section of the drill bit. Without being bound by theory, it is believed that when going from a hard to soft formation, greater back rake angles on the nose section reduce weight on the cone and shoulder sections. Moreover, greater back rake angles on the nose section may prevent over-engagement of the nose section by allowing the cone and shoulder sections to catch up to the nose section.

In some embodiments, all blades 114 of a drill bit may include primary cutters 116 having alternating positive back rake angles. In some embodiments, only some of the blades 114 may include primary cutters 116 having alternating positive back rake angles. That is, one or more blades 114 may not include primary cutters 116 having alternating positive back rake angles, although one or more of the back-up cutters 118 may have alternating positive back rake angles. In some embodiments, one or more blades 114 may include both primary cutters 116 having alternating positive back rake angles and back-up cutters 118 having alternating positive back rake angles.

By having alternating positive back rake angles, the back rake angles may alternate between aggressive (i.e., smaller back rake angle) and passive (i.e., larger back rake angle) along the blade, and may alternate between aggressive and passive along the entire cutting profile. The aggressive back rake angles may increase point loading. The passive back rake angles may protect against impact damage during formation transitions. Combining aggressive and passive back rake angles across the drill bit may be particularly beneficial for applications with heavy transitional drilling. Combining aggressive and passive back rake angles may provide forgiveness across formation transitions while maintaining ROP (rate of penetration) potential in each dedicated formation. Combining aggressive and passive back rake angles may also be beneficial for applications where torque fluctuation are common and can cause premature bit damage. The alternating back rake arrangements may also function as a depth of cut controller. The arrangement may be placed in various locations on the bit profile and works to progressively absorb changes in weight on bit.

In contrast to known back rake arrangements where the back rake angle of every other cutter remains the same and the difference between the back rake angles of the adjacent cutters remains the same, the present technology described herein varies the back rake angles of cutters and also varies the difference between the back rake angles of adjacent cutters at different sections of the cutting profile. The back rake arrangements described herein achieve increased bit durability, reduced vibration, and better bit control. The alternating positive back rake angle arrangements described herein result in smoother torque signature, less axial vibration damage, and less lateral vibration damage, leading to improved dull grading. The back rake arrangements described herein further requires less mechanical specific energy while maintaining a greater rate of penetration, and thus achieve improved drilling efficiency. The alternating positive back rake angle arrangements can be particularly beneficial for transitional drilling by maintaining ROP (rate of penetration) potential in each dedicated formation.

b. Side Rake Arrangement of Cutters

In addition to having alternating back rake angles, as described above, in some embodiments, at least some of the cutters, primary cutters 116 and/or back-up cutters 118, may also have non-zero side rake angles. In some embodiments, at least some of the cutters may have alternating side rake angles. As illustrated in FIGS. 5 and 6 and plotted in graphs of FIGS. 10A-10F, on each blade 114, at least some of the primary cutters 116 may have alternating side rake angles. Depending on the application, the back-up cutters 118 may or may not have alternating side rake angles. Thus, in some embodiments, at least some of the cutters may have both alternating positive back rake angles and alternating side rake angles.

The graphs of FIGS. 8A to 8G illustrate various embodiments of side rake configurations for fixed cutters on a rotary earth boring tool, such as a PDC bit or reamer. The horizontal axis represents successive positions of cutters along a blade, e.g., successive radial positions of adjacent cutters within a bit's cutting profile. The origin represents, in these examples, the bit axis, with successive positions along the horizontal axis representing positions closer to the gauge of the body of the tool and more distant from the bit axis. However, the patterns illustrated could be used in intermediate sections of the cutting profile or intermediate sections of a blade. The vertical axis indicates the side rake angle of the cutters. The graphs are not intended to imply any particular range of positions on a blade or within a cutting profile.

Figure 8A:
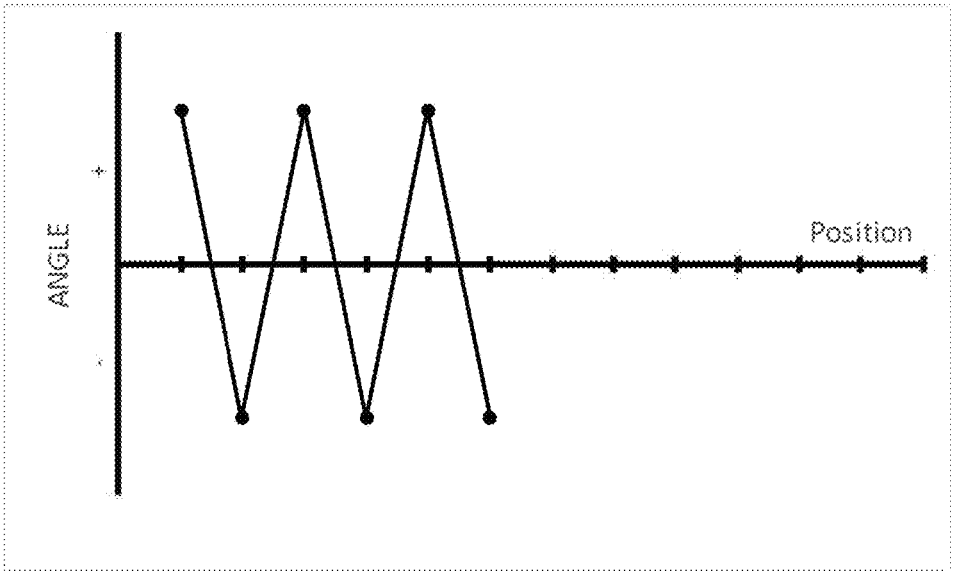
FIGS. 8A-8J are graphs showing exemplary side rake configurations for cutters on a drill bit, in accordance with some embodiments of the present invention.

The configuration of FIG. 8A represents a configuration in which the differences or changes in side rake angles of at least three cutters in adjacent positions alternate directions. For example, the angle of the cutter in the first position and the angle of the cutter in the second position have opposite polarities. The direction of change or the difference is negative. The change between the cutters in the second and the third positions is a direction opposite the direction of the change from the first to the second cutter. The angle increases, and the difference in angles is positive.

Figure 8B:
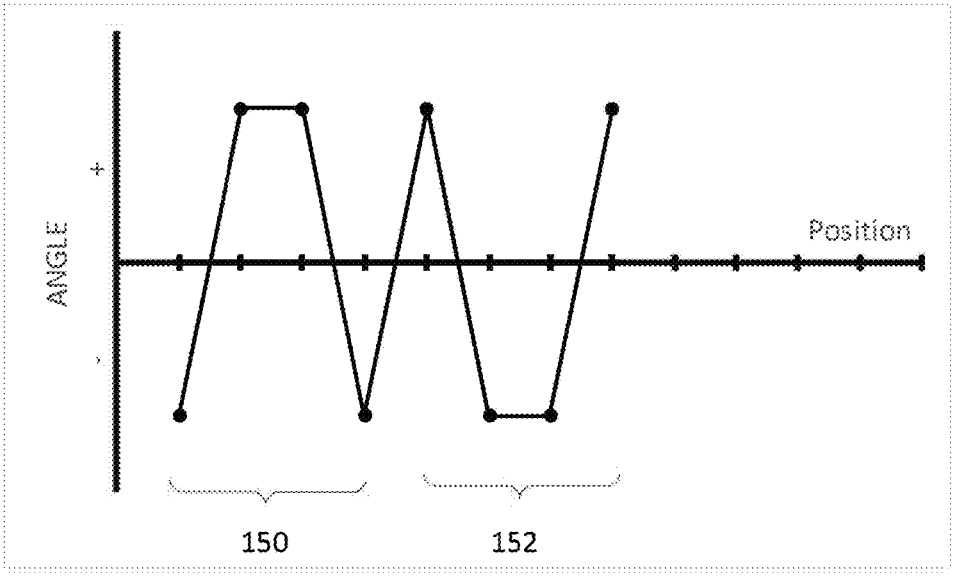

The pattern of FIG. 8B is similar to FIG. 8A, except that it is comprised of two related patterns 150 and 152, which are the inverse of each other. In each of these two patterns the change of the side rake angle from an individual cutter to a group of two (or more) cutters with a similar side rake angle is in one direction, and then the change in angle from the group to a single cutter is in the opposite direction.

Figure 8C:
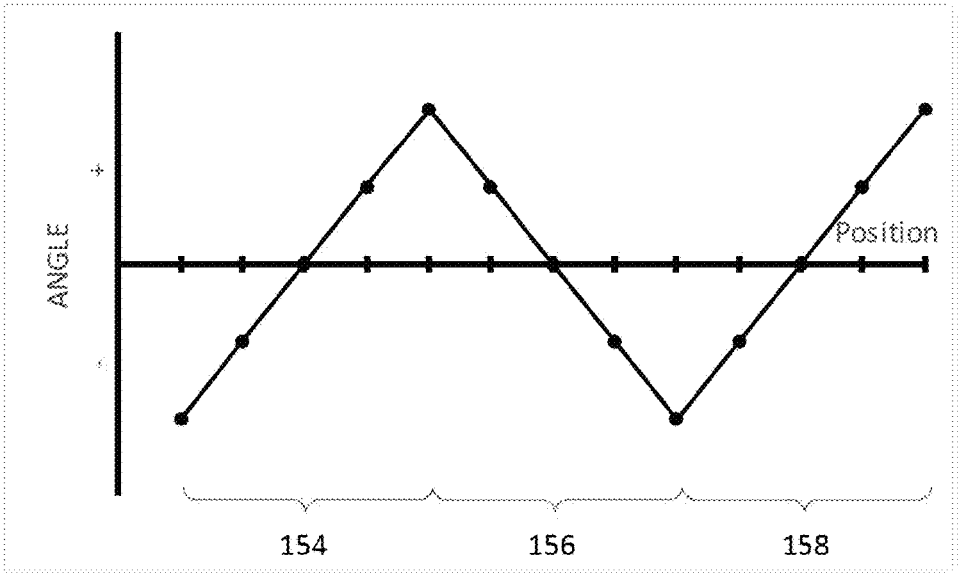

In the example configuration of FIG. 8C, the differences in side rake angles within group 154 of at least two successive cutters (four in the example) is in a first direction. The angle in this group progressively increases, in this example from negative to positive. In a next adjacent group 156 of two or more cutters, the side rake angles change in the opposite between adjacent members of cutters within that group. In this example, the angles decrease, and furthermore they decrease from being positive angles to negative angles. A third group of at least cutters 158, having increasing angles, and thus the direction of change in angle within this group is positive. The pattern thus illustrates an alternating of the direction of change within adjacent groups of cutters.

Figure 8D:
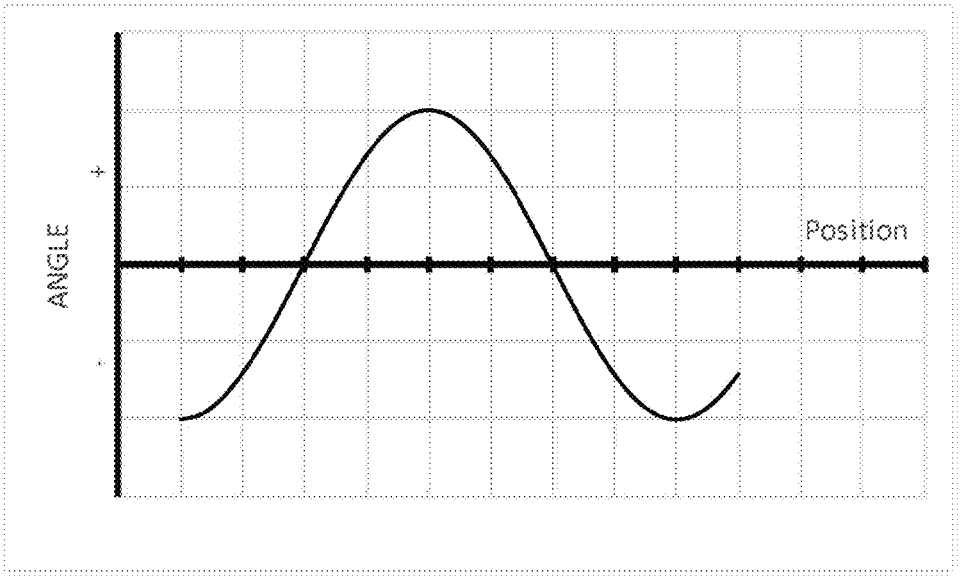

FIG. 8D is similar to FIG. 8C, except that the changes in side rake angles follow a sinusoidal pattern rather than the linear pattern.

Figure 8E:
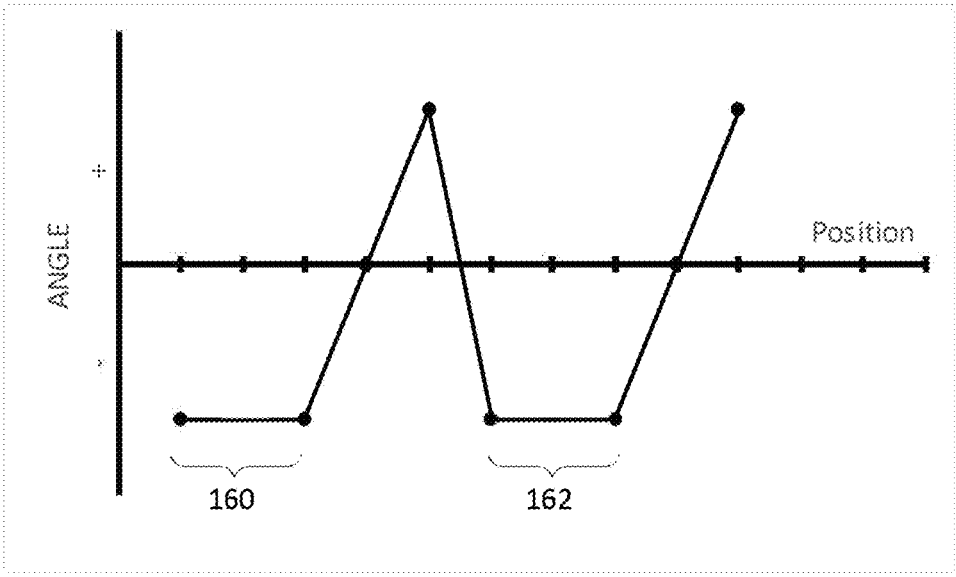

FIG. 8E shows an example of a pattern in which the side rake angles within groups 160 and 162 of two or more successive cutters are similar (for example, all the same magnitude, or all negative or positive) but that every third (or more) cutter 164 has a different angle (for example, positive when the angles in the groups 160 are negative). The angle changes in a first direction from group 160 to cutter 164, and then in the opposite direction between cutter 164 and group 162. Inverting the pattern is an alternative embodiment. The cutters having one polarity of side rake might be positioned on side of the bit and the cutters with the opposing polarity would be positioned on the other side of bit. For instance, one side rake would be used on blades 1 to 3 and the second side rake would be used on blades 4 to 6 of a six bladed bit.

Figure 8F:
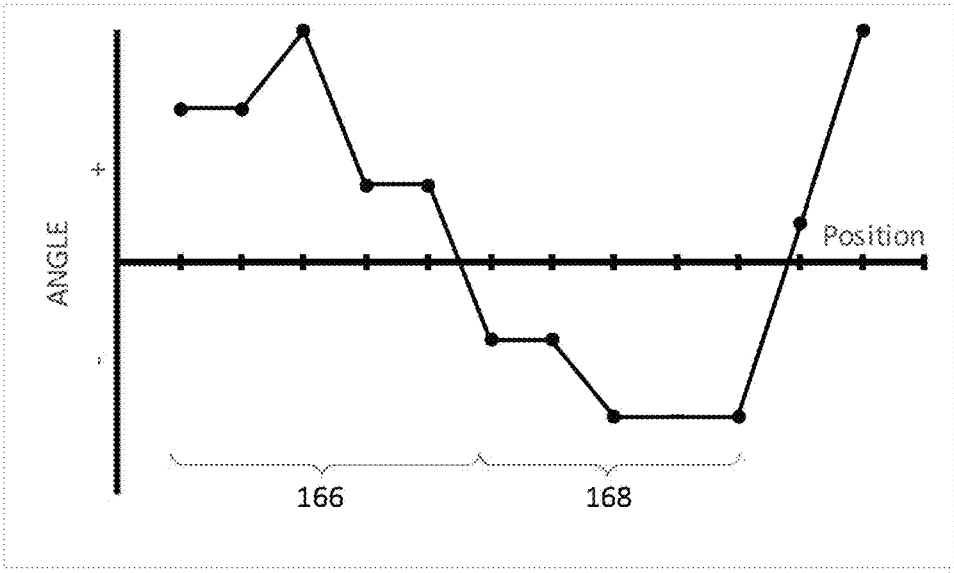

FIG. 8F is an example of pattern for a bit in which side rakes of two or more adjacent cutters with a group 166, for example within a cone of a bit, are positive, and then group of two or more adjacent cutters are negative in an adjacent a group 168. This second group could be, for example, along the nose and shoulder of the bit. The side rake angle then becomes positive again. The pattern also illustrates step-wise decreases or increases within a group.

Figure 8G:
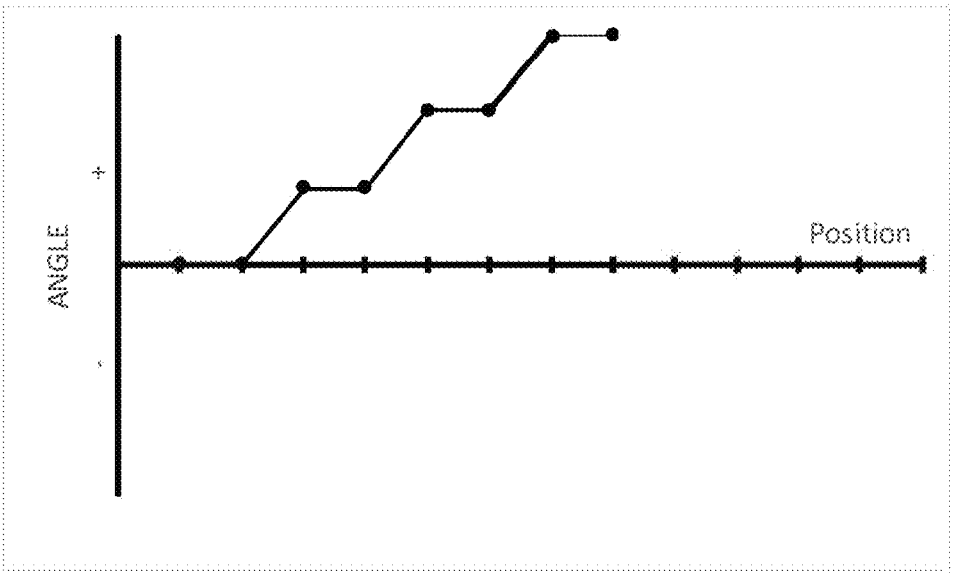

FIG. 8G is an example of a step-wise pattern or configuration in which the side rake angle is generally increasing. In this example, the side rake angle is increasing generally in a non-linear fashion, but the change in angle swings between an increasing direction and neutral. In this example the increasing positive side rake pushes cuttings increasingly to the outer diameter of the bit, increasing drilling efficiency.

In alternatives to the patterns or configurations of FIGS. 8A to 8D, patterns may be inverted. Furthermore, although the polarity of the angles (positive or negative) form part of the exemplary patterns, the values of the angles in alternative embodiments can be shifted positive or negative without changing other aspects of the pattern, namely the pattern in the directions of changes in the angle between adjacent cutters or group of cutters. In the configuration of FIG. 8A, for example, all of the cutters could have either positive or negative side rake without changing the alternating changes in direction of the differences between the cutters. Furthermore, the alternating pattern of positive and negative direction changes could occur first between cutters with positive angles, and then shift toward a mixture of positive and negative angles, and then toward all negative angles without interrupting the alternating pattern. Another alternative embodiment is a bit with, for instance, blades 1 to 3 having one side rake and blades 4 to 6 having the an opposing or substantially different side rake, similar to the arrangement shown in FIGS. 8E and 8F. This design could reduce walk tendency, and might be configured to be more laterally stable than a more conventional design.

Figure 8H:
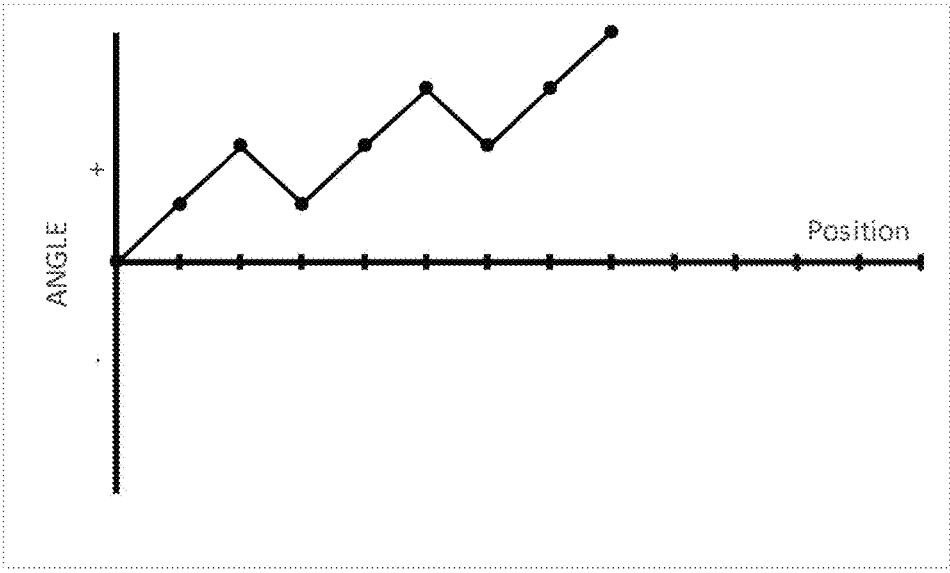
Figure 8I:
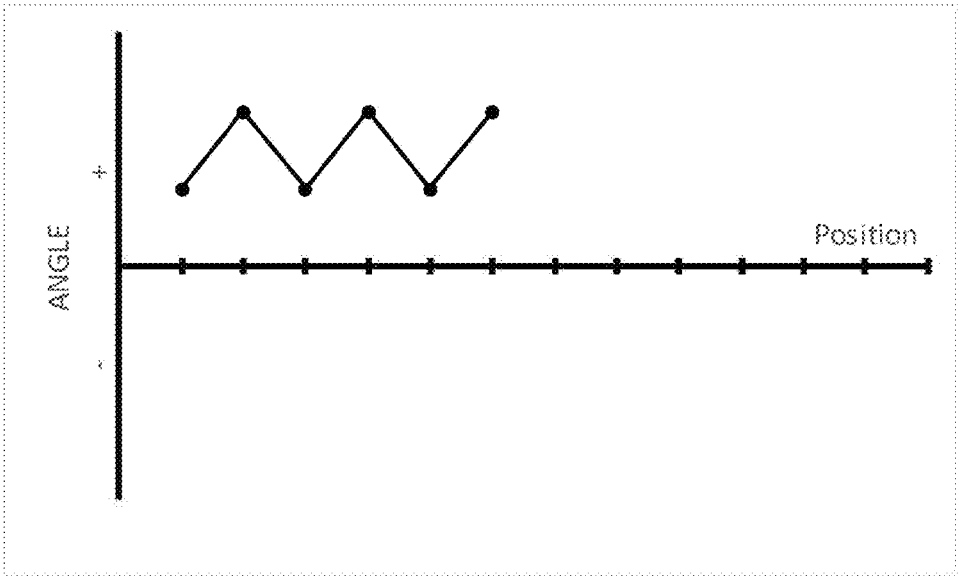
Figure 8J:
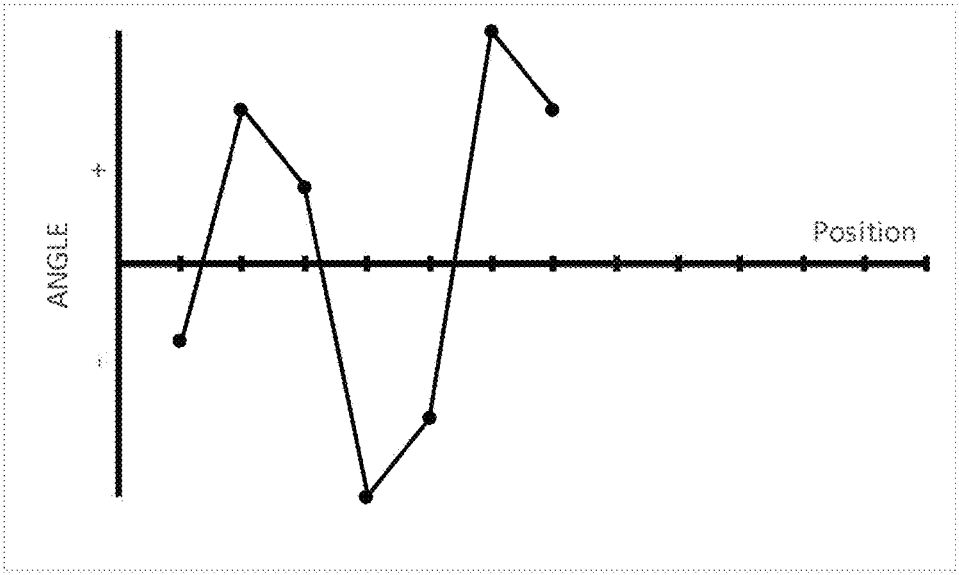
Figure 9A:
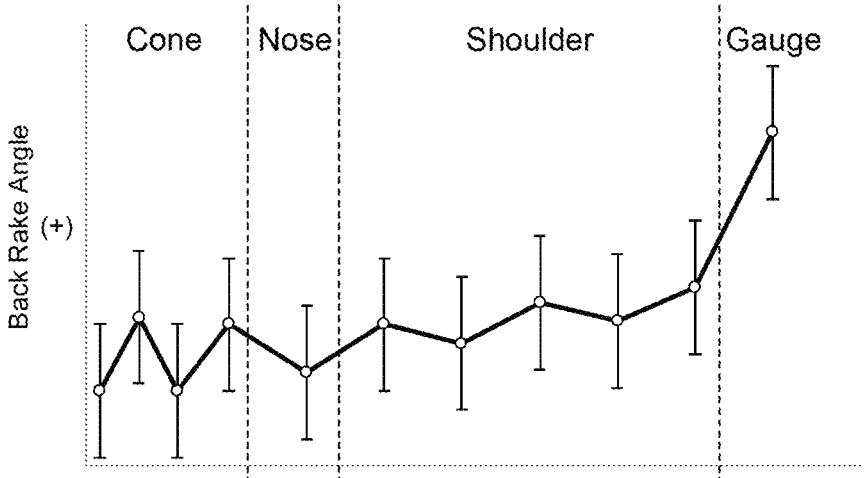
FIGS. 9A-9F show the back rake angles of cutters on blades of the drill bit of FIG. 5, in accordance with some embodiments of the present invention.
Figure 9B:
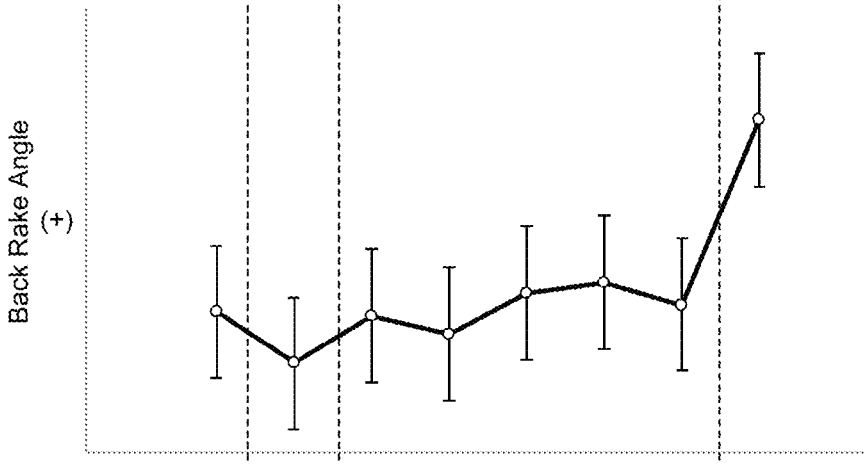
Figure 9C:
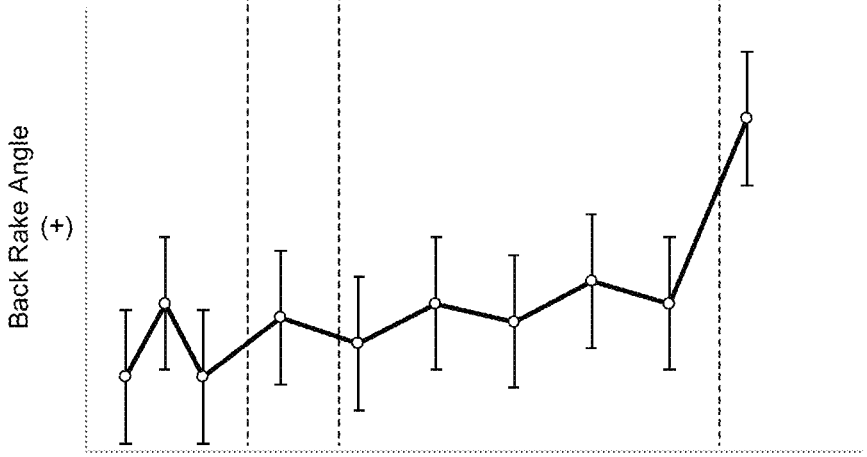
Figure 9D:
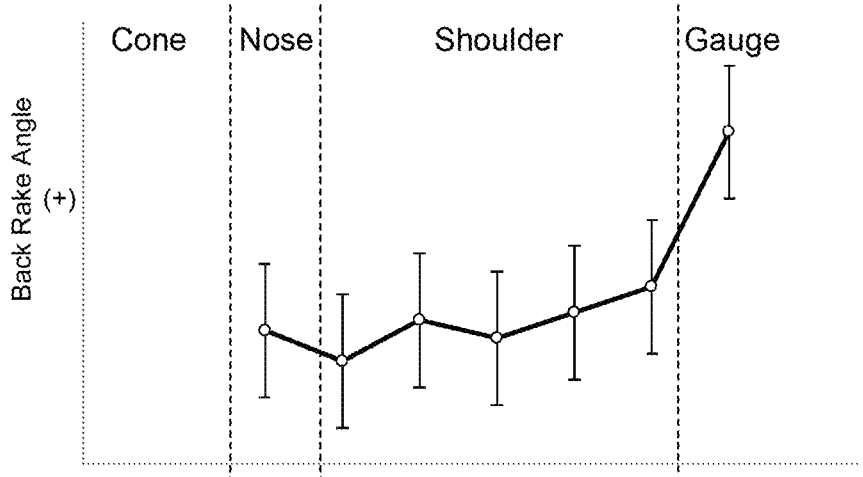
Figure 9E:
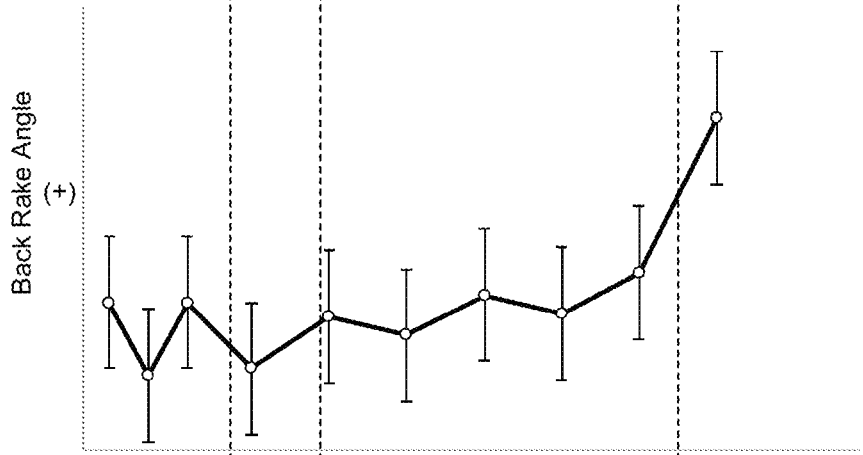
Figure 9F:
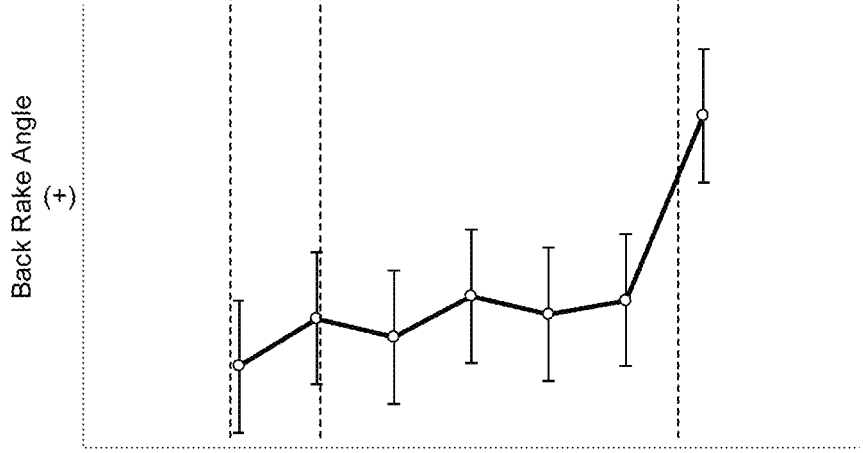
Figure 10A:
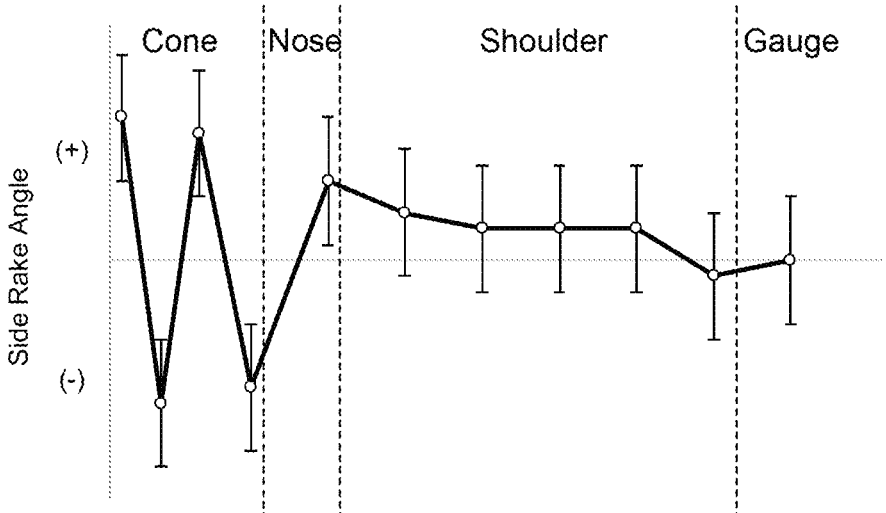
FIGS. 10A-10F show the side rake angles of cutters on blades of the drill bit of FIG. 5, in accordance with some embodiments of the present invention.
Figure 10B:
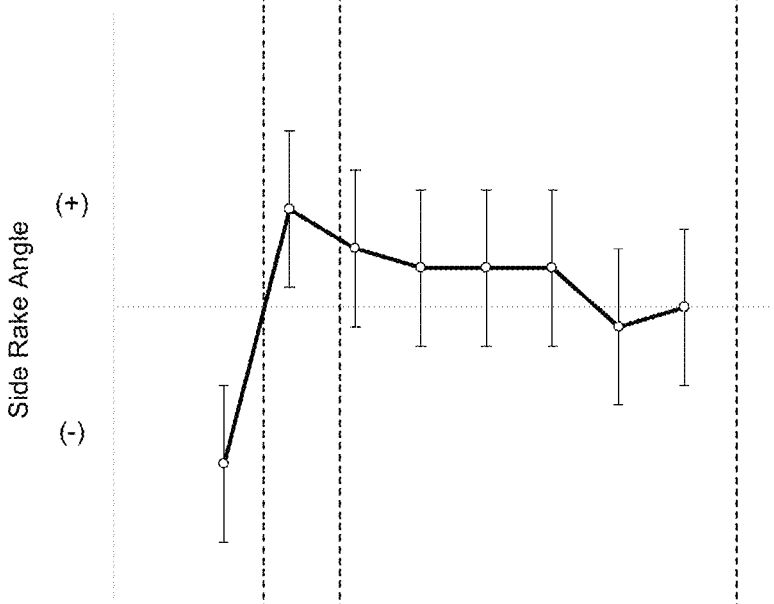
Figure 10C:
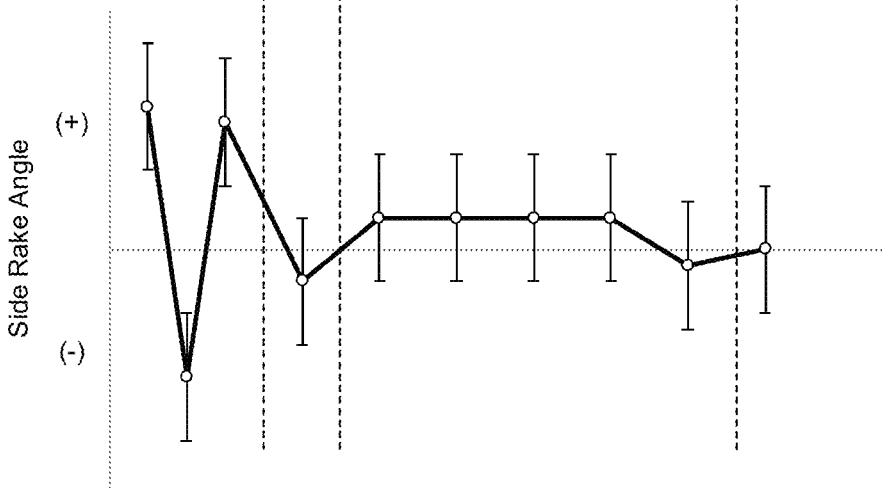
Figures 10D, 10E, 10F:
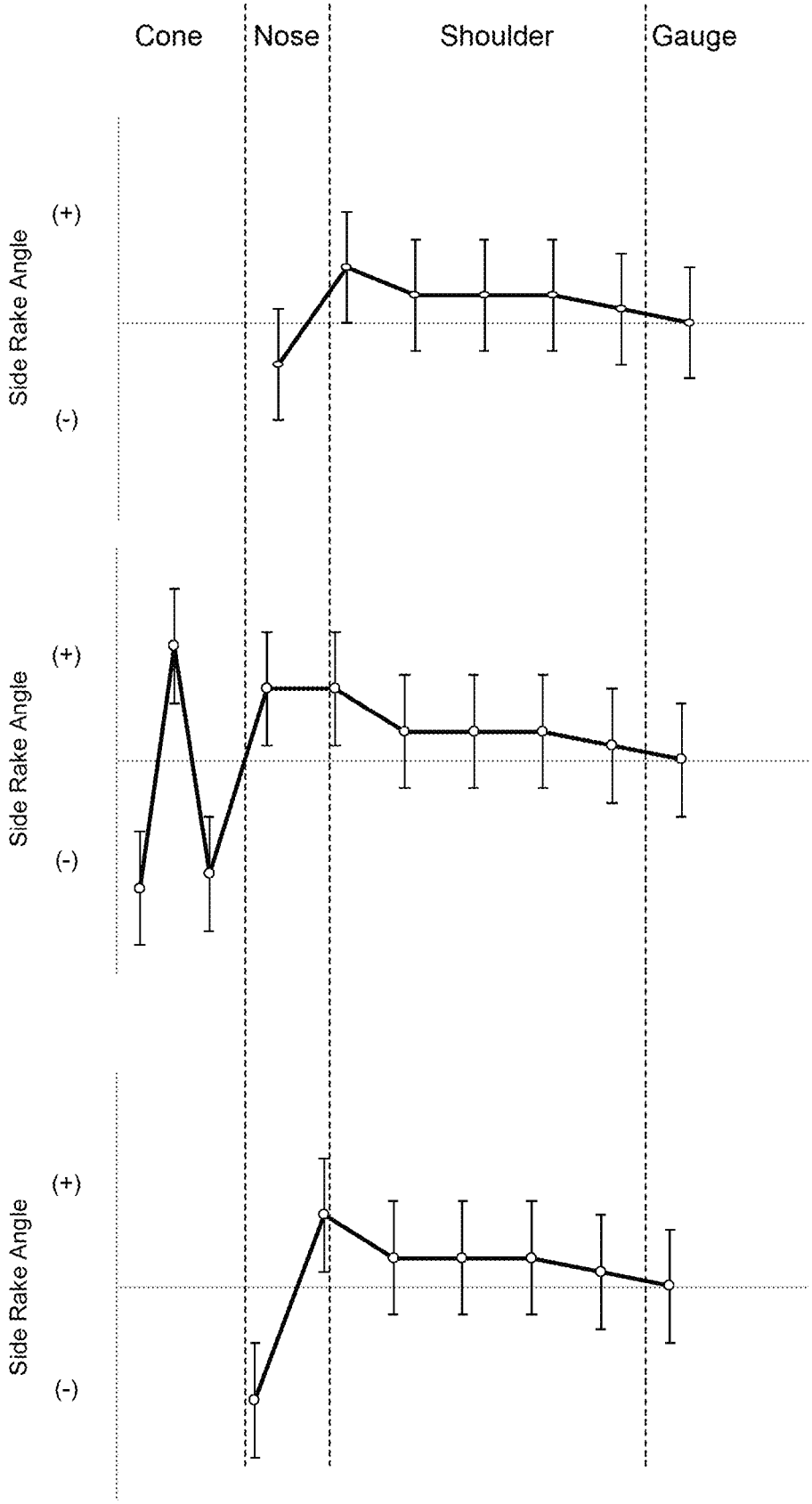

FIGS. 8H to 8J are additional examples of these alternative patterns. In FIG. 8H, the side rake angles are positive and generally increase. But, at some frequency, the angle decreases. In this example, the frequency is every third cutter in the sequence. However, a different frequency could be chosen, or the point at which the decrease occurs can be based on a transition between sections of the bit or blade, such as between cone and nose, nose and shoulder, and shoulder and gauge.

FIG. 8I is an alternative embodiment to FIG. 8A, in which the rake angles remain positive, but increase and decrease in an alternating fashion.

FIG. 8J illustrates that patterns of rake angle changes may also involve varying the magnitude of change in a rake angle between cutters in addition to direction.

A more thorough or complete description of drill bits including cutters having side rake angles is provided in U.S. Pat. No. 9,556,683.

Some of the benefits or advantages to adjusting side rakes of fixed cutters on earth boring tools with patterns such as those described above include one or more of the following:

Chip removal and chip evacuation by managing chip growth and the breakage or removal of cutting chips. This may be enhanced by having hydraulics tuned to enhance chip removal and/or the chip breaking effects.

Improved drilling efficiency achieved by reduced vibration and torque, as a result of managed side forces, reduced imbalance force and/or more efficient rock failure mechanisms. These might be achieved by managing force directions. Rock fracture communication between cutters is enhanced with engineered use of side rakes during bit design including rock fracture communication between primary and backup cutters. The modified elliptical cut shapes achieved with the use of side rake can have a dramatic effect on improving drilling efficiency and can be further enhanced by the position, size and/or orientation of backup cutters. In addition, the strategic use of side rake near or on gauge can also improve steerability.

Depth of cut (DOC) management by using different side rakes to give variable elliptical cut shapes in consort with position of backup elements to better manage depth-of-cut. This design concept may be adopted in discrete locations on the bit to maximize the benefits.

c. Cutter Variation

In addition to alternating back angles, the structures of the cutters may further vary. For example, the side rake angles of the cutters may vary as discussed above. In some embodiments, the size, exposure, being leached or non-leached, leached depth, chamfer, shape, and/or other parameters of the cutters may be varied to alter the aggressiveness of the cutters so as to achieve the various effects and/or benefits the alternating back rake angle arrangements may achieve.

In some embodiments, the cutters may include varying cutter sizes. In some embodiments, the diameters of the cutters may vary from blade to blade. In some embodiments, the diameters of the cutters may vary at different sections of the bit face. In some embodiments, the diameter of cutters disposed closer to the bit's axis of rotation may be greater than the diameter of cutters disposed more distant from the bit's axis of rotation. Thus, the diameters of the cutters may gradually decrease as the cutters are disposed further radially outward. For example, the diameters of the cutters in the cone section may be greater than the diameters of the cutters on the nose section, the shoulder section, and/or the gauge section. In some embodiments, the diameters of the cutters may gradually increase as the cutters are disposed further radially outward. In some embodiments, the diameters of the cutters may alternate along the length of the blade. In some embodiments, the cutters on the same bit may include at least two different sizes. For example, some of the cutters may include a size of 16±5 mm, 16±4 mm, 16±3 mm, 16±2 mm, 16±1 mm, or approximately 16 mm, and some of the cutters may include a size of 19±5 mm, 19±4 mm, 19±3 mm, 19±2 mm, 19±1 mm, or approximately 19 mm. In some embodiments, the cutters on the same bit may include three or more cutter sizes. In some embodiments, the size of the cutters on the same blade and/or the same bit may be consistent. In some embodiments, the cutters may also include varying cutter length. In some embodiments, the length of the cutters may vary from blade to blade and/or may vary at different sections of the bit face along the same blade. In some embodiments, the length of the cutters on the same blade and/or the same bit may be consistent.

In some embodiments, the cutters may also employ varying chamfer. For example, the edges of the cutters may be chamfered to alter the aggressiveness of the cutters. The chamfer size and/or chamfer angle of the cutters may vary from cutter to cutter. In some embodiments, the chamfer size and/or the chamfer angle of the cutters may vary at different sections of the bit face along the same or different blades. In some embodiments, the cutters may employ consistent chamfer for the cutters on the same blade and/or on the same bit.

In some embodiments, the shapes of the cutters may be consistent within the same blade and/or from blade to blade. In some embodiments, the shapes of the cutters may vary. Depending on the applications, the cutters may have a cylindrical cross section, an oblong or oval lateral cross section, or any other suitable cross sections. In some embodiments, the cross section of a cutter may further vary along the length of the cutter. In some embodiments, the cutter surface, such as the diamond table, may further include various structures to alter the aggressiveness of the cutter.

In some embodiments, the cutter exposure of the various cutters on each blade and/or the bit may be consistent. In some embodiments, the cutters may be mounted on the bit body such that the exposure of the cutters or the amount the cutters protrude from the bit body may vary to achieve different aggressiveness and/or mechanical strength of the cutters.

In some embodiments, some or all of the cutters may be leached. The leach depth may be consistent among various cutters or may vary from cutter to cutter, depending on the location and/or orientation of the cutters on the blade and/or on the bit.

Although several cutter parameters are described herein as non-limiting exemplary parameters that may be varied, other parameters of the cutter structure may be varied so as to vary the aggressiveness of the cutters and to achieve the various benefits and/or advantages that the alternating back rake angles may achieve.

IV. Offset Blade

Figure 11:
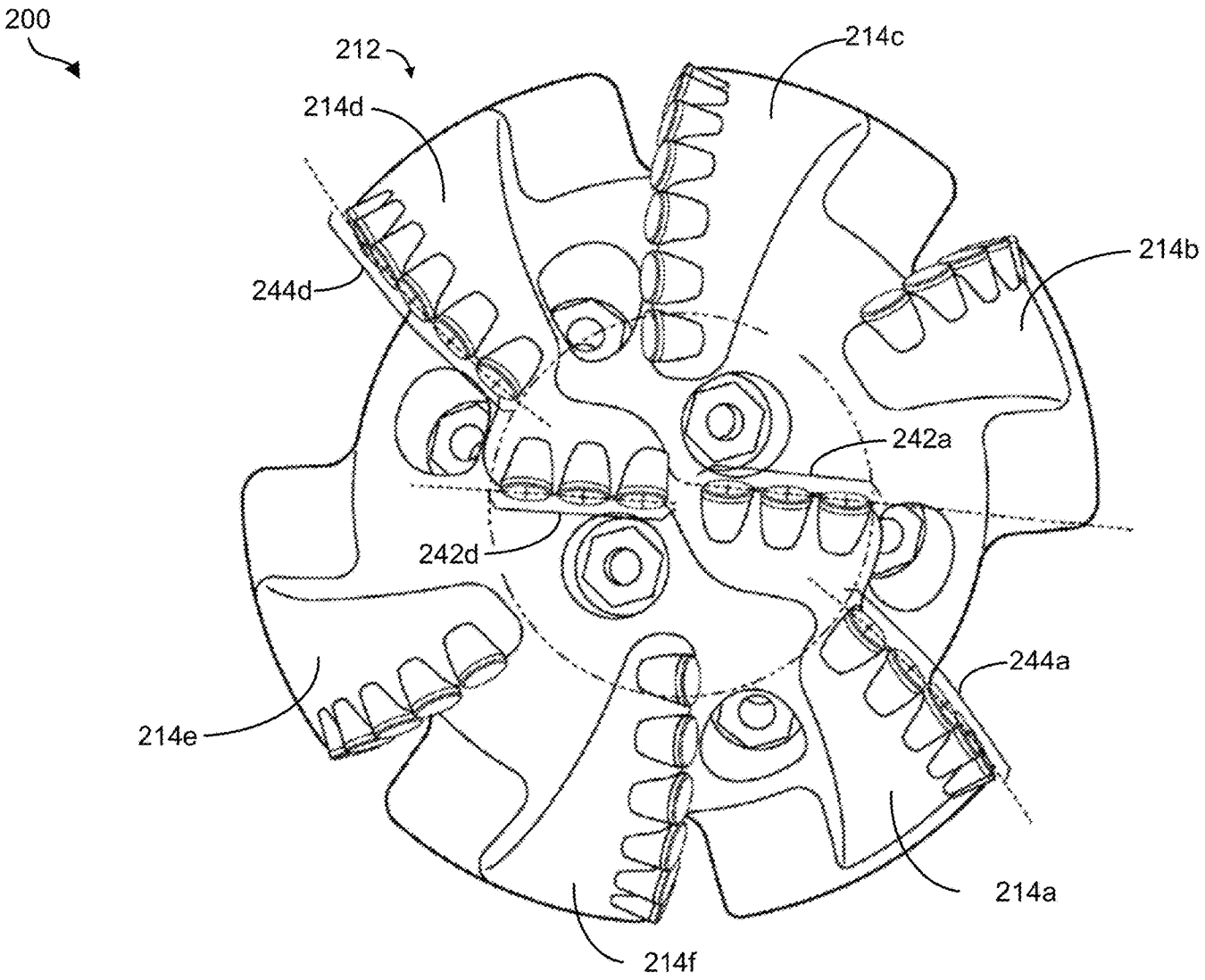
FIG. 11 shows a face view of another drill bit in accordance with some embodiments of the present invention.

FIG. 11 illustrates a face view of another drill bit 200. The drill bit 200 includes a plurality of raised blades 214*a*-214*f* disposed on the face 212. A major difference between the drill bit 200 and the drill bit 100 is related to the cutter arrangement along the radial extension of some of the blades. Specifically, some of the blades 214 are offset blades. In this example, blades 214*a* and 214*d* are offset blades, although the drill bit 200 may include greater or fewer number of blades 214 that are offset blades in other embodiments.

Each of the offset blades 214*a* and 214*d* may include an inner region and an outer region that are rotationally offset from the inner region. Each of the inner regions may support an inner set 242*a*, 242*d* of cutters along an inner leading edge portion of the offset blades 214*a* and 214*d*. Each of the outer regions may support an outer set 244*a*, 244*d* of cutters along an outer leading edge portion of the offset blades 214*a*, 214*d*. The inner and outer leading edge portions are rotationally offset from each other. Although six blades 214 are shown and two of the six blades 214 are offset blades, the bit 200 may include a different number of blades 214, a different number of offset blades, different lengths and/or locations of the inner regions and outer regions of the offset blades, and/or a different number of cutters supported by the inner and/or outer regions. A more thorough or complete description of drill bits having offset blades is provided in U.S. patent application Ser. No. 14/742,339, entitled "DRILL BIT", the entire disclosure of which is hereby incorporated by reference, for all purposes, as if fully set forth herein.

The back rake angle configuration and/or the side rake angle configuration discussed above may be implemented on at least some of the cutters on the blades 214*a*-214*f*. In some embodiments, at least some of the cutters of the inner set 242*a* and/or 242*d* on one or more of the offset blades 214*a* and 214*d* may have alternating positive back rake angles and/or alternating side rake angles. In some embodiments, at least some of the cutters of the outer set 244*a* and/or 244*d* of one or more of the offset blades 214*a* and 214*d* may have alternating positive back rake angles and/or alternating side rake angles. In some embodiments, the cutters on the other blades 214*b*, 214*c*, 214*e*, and/or 214*f* may also include alternating positive back rake angles and/or alternating side rake angles.

V. Example

The present invention will be better understood in view of the non-limiting examples.

Example 1

A steel drill bit having the alternating positive back rake angles in the cone section was prepared. The values of the back rake and side rake for each cutter are shown in Table 1. The cutters are numbered based on their radial positions from the bit axis, with cutter number one being closest to the bit axis. Cutters having consecutive cutter numbers are adjacent to one another in the cutting profile of the drill bit, although they may not be disposed on the same blade, such as shown in Table 1.

TABLE 1

| Cutter No. | Back Rake (degrees) | Side Rake (degrees) | Blade No. | Region of Bit |
|---|---|---|---|---|
| 1 | 10 | 9 | 1 | Cone |
| 2 | 20 | −9 | 5 | Cone |
| 3 | 10 | 9 | 3 | Cone |
| 4 | 20 | −9 | 1 | Cone |
| 5 | 10 | 8 | 5 | Cone |
| 6 | 20 | −8 | 3 | Cone |
| 7 | 10 | 8 | 1 | Cone |

TABLE 1-continued

| Cutter No. | Back Rake (degrees) | Side Rake (degrees) | Blade No. | Region of Bit |
|---|---|---|---|---|
| 8 | 20 | −8 | 5 | Cone |
| 9 | 10 | 8 | 3 | Cone |
| 10 | 19 | −8 | 2 | Cone |
| 11 | 19 | −8 | 1 | Cone |

Comparative Example A

A drill bit was prepared as in Example 1, except that the back rake in the cone section was not varied and the drill bit had a matrix body.

The drill bits of Example 1 and Comparative Example A were tested in the same well. The drill bit of Example 1 was run for 82 hours. Its initial measured depth was 1732 feet and its measured depth when removed was 6909 feet. Next, the drill bit of Comparative Example A was run for 55 hours at an initial measured depth of 6909 feet and its measure depth when removed was 9831 feet. Each bit was run at 70 revolutions per minute. The weight on bit, string torque, motor torque, effective torque, mechanical specific energy, and rate of penetration were measured. The results are shown in Table 2 below.

TABLE 2

| Example | 1 | Comparative A |
|---|---|---|
| Weight on Bit | 18-25K lbs (80-111K N) | 20-25K lbs. (89-111K N) |
| String Torque | 12,000 ft-lbs (16,270 Nm) | 14,000 ft-lbs. (18,981 Nm) |
| Motor Torque | 7,000 ft-lbs (9,491 Nm) | 6,000 ft.-lbs. (8,135 Nm) |
| Effective Torque | 13,000 ft-lbs (17,626 Nm) | 11,600 ft-lbs (15,727 Nm) |
| Mechanical Specific Energy | 50-150K psi ($3.4\text{-}10.3 \times 10^8$ Pa) | 200-300K psi ($13.8\text{-}20.7 \times 10^8$ Pa) |
| Rate of Penetration | 80 ft/hr (24 m/hr) | 40-60 ft/hr (12-18 m/hr) |

Weight on bit (WOB) refers to the amount of downward force exerted on the drill bit in order to effectively break rock. String torque refers to the mechanical rotary torque directly applied to the drilling string assembly from the drilling rig at surface. Motor torque refers to additional rotary torque generated down hole by fluid flow through the positive displacement motor, as a correlated function of the pressure drop across the motor. Effective torque refers to a calculated model of the total torsional energy that is being delivered to the bit by the entire drilling system, mechanically and hydraulically generated torque minus system losses and inefficiencies. Mechanical specific energy (MSE) is the amount of energy required to remove a unit volume of rock, with units typically in psi.

As shown in Table 2, Example 1 had a lower mechanical specific energy than Comparative Example A while having a greater rate of penetration, indicating superior drilling efficiency. Example 1 also had better effective torque.

VI. Embodiments

Embodiment 1 is a drill bit, comprising: a body having a face and a central bit axis; a blade disposed on the face of the body; and a row of cutters disposed on the blade, at least some of the cutters having alternating positive back rake angles, wherein the difference between a majority of back rake angles on adjacent cutters is less than 20°.

Embodiment 2 is the drill bit of any previous or subsequent Embodiment, wherein the difference between the back rake angles on two adjacent cutters is greater than the difference between the back rake angles on another two adjacent cutters that are disposed radially further outward.

Embodiment 3 is the drill bit of any previous or subsequent Embodiment, wherein the difference between the back rake angles on two adjacent cutters is less than the difference between the back rake angles on another two adjacent cutters that are disposed radially further outward.

Embodiment 4 is the drill bit of any previous or subsequent Embodiment, wherein the back rake angles on every other cutter gradually increases as the cutters are disposed radially further outward.

Embodiment 5 is the drill bit of any previous or subsequent Embodiment, wherein the face comprises a cone section disposed about the central bit axis, wherein at least one cutter has a back rake angle less than the back rake angles on adjacent cutters, and wherein one of the adjacent cutters is disposed on the cone section.

Embodiment 6 is the drill bit of any previous or subsequent Embodiment, wherein the face comprises a cone section disposed about the central bit axis and a nose section surrounding the cone section, wherein at least one cutter has a back rake angle less than the back rake angles on adjacent cutters, and wherein the at least one cutter is disposed on the nose section.

Embodiment 7 is the drill bit of any previous or subsequent Embodiment, wherein the face comprises a cone section disposed about the central bit axis, a nose section surrounding the cone section, and a shoulder section disposed radially outward from the cone and nose sections, wherein at least one cutter has a back rake angle greater than the back rake angles on adjacent cutters, and wherein the at least one cutter is disposed on the shoulder section.

Embodiment 8 is the drill bit of any previous or subsequent Embodiment, wherein each cutter of the row of cutters has a cutter face forming a cutting surface and a longitudinal cutter axis passing through the cutter face, and wherein the cutter face of at least one cutter is slanted with respect to the longitudinal cutter axis of the at least one cutter.

Embodiment 9 is the drill bit of any previous or subsequent Embodiment, wherein the face comprises a cone section, and wherein the cutters having alternating positive back rake angles are disposed on the cone section.

Embodiment 10 is the drill bit of any previous or subsequent Embodiment, wherein the face comprises a shoulder section, and wherein the cutters having alternating positive back rake angles are disposed on the shoulder section.

Embodiment 11 is the drill bit of any previous or subsequent Embodiment, wherein the face comprises a cone section disposed about the central bit axis and a shoulder section disposed radially outward from the cone section, and wherein the cutters having alternating positive back rake angles are disposed on the cone section and the shoulder section.

Embodiment 12 is the drill bit of any previous or subsequent Embodiment, wherein the face comprises a gauge section, and wherein the cutters having alternating positive back rake angles are disposed on the gauge section.

Embodiment 13 is the drill bit of any previous or subsequent Embodiment, wherein the face comprises a cone section disposed about the central bit axis, a nose section surrounding the cone section, a shoulder section disposed radially outward from the cone and nose sections, and a longitudinally extending gauge section, wherein the row of cutters extends from the cone section to the gauge section and the cutters having alternating positive back rake angles are disposed on at least one of the cone section, the nose section, the shoulder section or the gauge section.

Embodiment 14 is the drill bit of any previous or subsequent Embodiment, wherein at least some of the cutters having alternating positive back rake angles also have alternating side rake angles.

Embodiment 15 is the drill bit of any previous or subsequent Embodiment, wherein when the row of cutters is a row of primary cutters, the drill bit further comprising a row of back-up cutters.

Embodiment 16 is the drill bit of any previous or subsequent Embodiment, wherein when the row of cutters is a row of back-up cutters, the drill bit further comprising a row of primary cutters.

Embodiment 17 is the drill bit of any previous or subsequent Embodiment, wherein the blade comprises an inner region and an outer region rotationally offset from the inner region, and wherein the row of cutters is disposed on at least one of the inner region, the outer region, or combinations thereof.

Embodiment 18 is the drill bit of any previous or subsequent Embodiment, wherein the row of cutters further comprises cutters that do not have alternating positive back rake angles.

Embodiment 19 is a drill bit, comprising: a body having a face and a central bit axis; a blade disposed on the face of the body; and a plurality of first and second cutters arranged in an alternating manner on the blade, wherein the plurality of first cutters each have a positive back rake angle within a first range of ±9°, wherein the plurality of second cutters each have a positive back rake angle within a second range of ±9°, and wherein the difference of the average of the first range and the average of the second range is from 5 to 20°.

Embodiment 20 is the drill bit of any previous or subsequent Embodiment, wherein the plurality of first cutters each have a positive back rake angle within a first range of ±9°, wherein the plurality of second cutters each have a positive back rake angle within a second range of ±9°, and wherein the difference of the average of the first range and the average of the second range is from 5 to 10.

Embodiment 21 is the drill bit of any previous or subsequent Embodiment, wherein the plurality of first cutters each have a positive back rake angle within a first range of ±9°, wherein the plurality of second cutters each have a positive back rake angle within a second range of ±9°, and wherein the difference of the average of the first range and the average of the second range is from 10 to 20°.

Embodiments 22 is the drill bit of any previous or subsequent Embodiment, wherein the plurality of first cutters each have a positive back rake angle within a first range of ±5°, wherein the plurality of second cutters each have a positive back rake angle within a second range of ±5°, and wherein the difference of the average of the first range and the average of the second range is from 5 to 20°.

Embodiment 23 is the drill bit of any previous or subsequent Embodiment, wherein the face comprises a cone section disposed about the central bit axis and a shoulder section disposed radially outward from the cone section, and wherein at least some of alternating first and second cutters are disposed on at least one of the cone section or the shoulder section.

Embodiment 24 is the drill bit of any previous or subsequent Embodiment, wherein the face comprises a nose section and a shoulder section disposed radially outward from the nose section, and wherein at least some of the alternating first and second cutters are disposed on the nose section and the shoulder section.

Embodiment 25 is the drill bit of any previous or subsequent Embodiment, wherein at least some of the plurality of first cutters further have non-zero side rake angles.

Embodiment 26 is the drill bit of any previous or subsequent Embodiment, wherein the blade comprises an inner region and an outer region rotationally offset from the inner region, wherein at least some of the plurality of first and second cutters are disposed on at least one of the inner region or the outer region.

Embodiment 27 is a drill bit, comprising: a body having a central bit axis about which the drill bit is intended to rotate; a blade disposed on the body; and at least two pairs of cutters on the blade, the cutters in each of the pairs of cutters being mounted in adjacent, fixed positions on the blade, the cutters partially defining at least a portion of a cutting profile for the drill bit when the drill bit is rotated, each of the cutters having a predetermined radial position within the cutting profile based on its distance from the central bit axis, and a predetermined orientation for its cutting face; wherein the predetermined orientation comprises different non-zero back rake angles on each of the cutters within the at least two pairs of cutters, the cutters in each pair of cutters having different back rake angles with respect to the other of the cutters within each pair of cutters, and wherein the difference between the back rake angles within each of the pairs of the cutters is less than 20°.

Embodiment 28 is the drill bit of any previous or subsequent Embodiment, wherein the difference between the back rake angles within each of the pairs of the cutters is less than 10°.

Embodiment 29 is the drill bit of any previous or subsequent Embodiment, wherein the predetermined orientation further comprises a non-zero side rake angle.

Embodiment 30 is the drill bit of any previous or subsequent Embodiment, wherein each pair of cutters in the at least two pairs of cutters have side rake angles that converge on one another.

Embodiment 31 is the drill bit of any previous or subsequent Embodiment, wherein at least one of the two pairs of cutters is disposed in a cone section of the cutting profile.

Embodiment 32 is the drill bit of any previous or subsequent Embodiment, wherein at least one of the two pairs of cutters is disposed in a shoulder section of the cutting profile.

Embodiment 33 is a drill bit, comprising: a body having a face on which is defined a plurality of blades extending from the face and separated by channels between the blades, each blade supporting a plurality of cutters, at least one of the blades being an offset blade including: an inner region supporting an inner set of cutters along a first leading edge portion of the offset blade; an outer region supporting an outer set of cutters along a second leading edge portion of the offset blade, wherein the second leading edge portion is rotationally offset from the first leading edge portion; and wherein at least one of the inner set of cutters or the outer set of cutters has alternating positive back rake angles, and wherein the difference between adjacent back rake angles is less than 20°.

Embodiment 34 is the drill bit of any previous or subsequent Embodiment, wherein the difference between adjacent back rake angles is less than 10°.

Embodiment 35 is the drill bit of any previous or subsequent Embodiment, wherein the inner set of cutters has alternating positive back rake angles.

Embodiment 36 is the drill bit of any previous or subsequent Embodiment, wherein the outer set of cutters has alternating positive back rake angles.

Embodiment 37 is the drill bit of any previous or subsequent Embodiment, wherein the inner set of cutters and the outer set of cutters have alternating positive back rake angles.

Embodiment 38 is the drill bit of any previous or subsequent Embodiment, wherein at least one of the inner set of cutters or the outer set of cutters has alternating side rake angles.

Embodiment 39 is a method of using a drill bit, comprising: disposing a drill bit to drill a borehole; and drilling the borehole with the drill bit, wherein the drill bit comprises: a body having a face and a central bit axis; a blade disposed on the face of the body; and a row of cutters disposed on the blade, at least some of the cutters having alternating positive back rake angles, wherein the difference between a majority of back rake angles on adjacent cutters is less than 20°.

Embodiment 40 is a method of drilling a subterranean formation, comprising: engaging a subterranean formation with at least one cutter of a drill bit, wherein the drill bit comprises: a body having a face and a central bit axis; a blade disposed on the face of the body; and a plurality of first and second cutters arranged in an alternating manner on the blade, wherein the plurality of first cutters each have a positive back rake angle within a first range of ±9°, wherein the plurality of second cutters each have a positive back rake angle within a second range of ±9°, and wherein the difference of the average of the first range and the average of the second range is from 5 to 20°.

Embodiment 41 is a method of configuring a drill bit, comprising: configuring a bit body having a face and a central bit axis; configuring a blade on the face of the body; and configuring a row of cutters on the blade, at least some of the cutters having alternating positive back rake angles, wherein the difference between a majority of back rake angles on adjacent cutters is less than 20°.

Embodiment 42 is a method of making a drill bit, comprising: providing a bit body having a face, a blade on the face, and a row of cutters on the blade based on a predetermined back rake angle arrangement such that at least some of the cutters have alternating positive back rake angles and such that the difference between a majority of back rake angles on adjacent cutters is less than 20°.

Embodiment 43 is a drill bit, comprising: a body having a face and a central bit axis; and a plurality of blades disposed on the face of the body, each of the plurality of blades having a row of cutters disposed thereon, the rows of cutters collectively defining a cutting profile of the drill bit, at least some of the cutters along the cutting profile having alternating positive back rake angles; wherein the difference between a majority of back rake angles on adjacent cutters along the cutting profile is less than 20°.

Embodiment 44 is the drill bit of any previous or subsequent Embodiment, wherein adjacent cutters of the at least some of the cutters along the cutting profile having alternating positive back rake angles are disposed on different blades.

Embodiment 45 is the drill bit of any previous or subsequent Embodiment, wherein at least some cutters of the row of cutters disposed on one blade of the plurality of blades have alternating positive back rake angles.

Embodiment 46 is the drill bit of any previous or subsequent Embodiment, wherein the at least some of the cutters along the cutting profile having alternating positive back rake angles include a first plurality of cutters and a second plurality of cutters, wherein each of the first plurality of cutters has a positive back rake angle within a first range, wherein each of the second plurality of cutters has a positive back rake angle within a second range different from the first range.

Embodiment 47 is the drill bit of any previous or subsequent Embodiment, wherein the difference of the average of the first range and the average of the second range is from 5 to 20°.

Embodiment 48 is the drill bit of any previous or subsequent Embodiment, wherein at least some of the first plurality of cutters is disposed on a first blade of the plurality of blades, and wherein at least some of the second plurality of cutters is disposed on a second blade of the plurality of blades.

Embodiment 49 is the drill bit of any previous or subsequent Embodiment, wherein the first blade and the second blade are adjacent to each other.

Embodiment 50 is the drill bit of any previous or subsequent Embodiment, wherein the plurality of blades includes a first set of blades and a second set of blades, wherein at least some of the cutters disposed on the first set of blades have back rake angles within the first range, wherein at least some of the cutters disposed on the second set of blades have back rake angles within the second range, and wherein the first set of blades and the second set of blades are arranged in an alternating manner.

Embodiment 51 is the drill bit of any previous or subsequent Embodiment, wherein the first plurality of cutters includes a first set of at least two adjacent cutters along the cutting profile, and wherein the second plurality of cutters includes a second set of at least two adjacent cutters along the cutting profile.

Embodiment 52 is the drill bit of any previous or subsequent Embodiment, wherein the first set and the second set are arranged in a consecutive manner along the cutting profile.

Embodiment 53 is the drill bit of any previous or subsequent Embodiment, wherein the difference between the back rake angles on two adjacent cutters is greater than the difference between the back rake angles on another two adjacent cutters that are disposed radially further outward.

Embodiment 54 is the drill bit of any previous or subsequent Embodiment, wherein the face comprises a cone section disposed about the central bit axis, wherein at least some of the cutters having alternating positive back rake angles are disposed on the cone section.

Embodiment 55 is the drill bit of any previous or subsequent Embodiment, wherein the face comprises a cone section disposed about the central bit axis and a nose section surrounding the cone section, wherein at least some of the cutters having alternating positive back rake angles are disposed on at least one of the cone section or the nose section.

Embodiment 56 is the drill bit of any previous or subsequent Embodiment, wherein the face comprises a cone section disposed about the central bit axis, a nose section surrounding the cone section, and a shoulder section disposed radially outward from the cone and nose sections, wherein at least some of the cutters having alternating positive back rake angles are disposed on at least one of the cone section, the nose section, or the shoulder section.

Embodiment 57 is the drill bit of any previous or subsequent Embodiment, wherein at least some of the cutters having alternating positive back rake angles also have alternating side rake angles.

Embodiment 58 is the drill bit of any previous or subsequent Embodiment, wherein the rows of cutters are rows of primary cutters, and wherein each of the plurality of blades further includes a row of back-up cutters.

Embodiment 59 is the drill bit of any previous or subsequent Embodiment, wherein the rows of cutters are rows of back-up cutters, and wherein each of the plurality of blades further includes a row of primary cutters.

Embodiment 60 is the drill bit of any previous or subsequent Embodiment, wherein at least one of the blades comprises an inner region and an outer region rotationally offset from the inner region, and wherein at least some of the cutters having alternating positive back rake angles are disposed on at least one of the inner region, the outer region, or combinations thereof.

Embodiment 61 is the drill bit of any previous or subsequent Embodiment, wherein the rows of cutters further comprise cutters that do not have alternating positive back rake angles along the cutting profile.

Embodiment 62 is a method of using a drill bit, comprising: drilling a borehole with a drill bit, wherein the drill bit comprises: a body having a face and a central bit axis; and a plurality of blades disposed on the face of the body, each of the plurality of blades having a row of cutters disposed thereon, the rows of cutters collectively defining a cutting profile of the drill bit, at least some of the cutters along the cutting profile having alternating positive back rake angles; wherein the difference between a majority of back rake angles on adjacent cutters along the cutting profile is less than 20°.

While the invention has been described in detail, modifications within the spirit and scope of the invention will be readily apparent to those of skill in the art. It should be understood that aspects of the invention and portions of various embodiments and various features recited above and/or in the appended claims may be combined or interchanged either in whole or in part. In the foregoing descriptions of the various embodiments, those embodiments which refer to another embodiment may be appropriately combined with other embodiments as will be appreciated by one of ordinary skill in the art. Furthermore, those of ordinary skill in the art will appreciate that the foregoing description is by way of example only, and is not intended to limit the invention. All US patents and publications cited herein are incorporated by reference in their entirety.

What is claimed is:

1. A drill bit, comprising:

a body having a face and a central bit axis; and a plurality of blades disposed on the face of the body, each of the plurality of blades having a row of cutters disposed thereon, the rows of cutters collectively defining a cutting profile of the drill bit, wherein:

wherein a nose region and a cone region of the face, at least six radially adjacent cutters of the cutters along the cutting profile having alternating positive back rake angles;

at least some adjacent cutters of the cutters along the cutting profile have non-alternating back rake angles; and the difference between a majority of back rake angles on adjacent cutters along the cutting profile is less than 20°.

2. The drill bit of claim 1, wherein adjacent cutters of the at least some of the cutters along the cutting profile having alternating positive back rake angles are disposed on different blades.

3. The drill bit of claim 1, wherein at least some cutters of the row of cutters disposed on one blade of the plurality of blades have alternating positive back rake angles.

4. The drill bit of claim 1, wherein the at least some of the cutters along the cutting profile having alternating positive back rake angles include a first plurality of cutters and a second plurality of cutters, wherein each of the first plurality of cutters has a positive back rake angle within a first range, wherein each of the second plurality of cutters has a positive back rake angle within a second range different from the first range.

5. The drill bit of claim 4, wherein the difference of the average of the first range and the average of the second range is from 5 to 20°.

6. The drill bit of claim 4, wherein at least some of the first plurality of cutters is disposed on a first blade of the plurality of blades, and wherein at least some of the second plurality of cutters is disposed on a second blade of the plurality of blades.

7. The drill bit of claim 6, wherein the first blade and the second blade are adjacent to each other.

8. The drill bit of claim 4, wherein the plurality of blades includes a first set of blades and a second set of blades, wherein at least some of the cutters disposed on the first set of blades have back rake angles within the first range, wherein at least some of the cutters disposed on the second set of blades have back rake angles within the second range, and wherein the first set of blades and the second set of blades are arranged in an alternating manner.

9. The drill bit of claim 4, wherein the first plurality of cutters includes a first set of at least two adjacent cutters along the cutting profile, and wherein the second plurality of cutters includes a second set of at least two adjacent cutters along the cutting profile.

10. The drill bit of claim 9, wherein the first set and the second set are arranged in a consecutive manner along the cutting profile.

11. The drill bit of claim 1, wherein the difference between the back rake angles on two adjacent cutters is greater than the difference between the back rake angles on another two adjacent cutters that are disposed radially further outward.

12. The drill bit of claim 1, wherein the face comprises a shoulder section disposed radially outward from the cone and nose regions, wherein at least some of the cutters within the shoulder section have alternating positive back rake angles.

13. The drill bit of claim 1, wherein at least some of the cutters having alternating positive back rake angles also have alternating side rake angles.

14. The drill bit of claim 1, wherein the rows of cutters are rows of primary cutters, and wherein each of the plurality of blades further includes a row of back-up cutters.

15. The drill bit of claim 1, wherein the rows of cutters are rows of back-up cutters, and wherein each of the plurality of blades further includes a row of primary cutters.

16. The drill bit of claim 1, wherein at least one of the blades comprises an inner region and an outer region rotationally offset from the inner region, and wherein at least some of the cutters having alternating positive back rake angles are disposed on at least one of the inner region, the outer region, or combinations thereof.

17. The drill bit of claim 1, wherein the rows of cutters further comprise cutters that do not have alternating positive back rake angles along the cutting profile.

18. The drill bit of claim 1, wherein the at least some adjacent cutters of the cutters along the cutting profile having non-alternating back rake angles are radially outward of the at least six radially adjacent cutters.

19. A method of using a drill bit, comprising:

drilling a borehole with a drill bit, wherein the drill bit comprises:

a body having a face and a central bit axis; and a plurality of blades disposed on the face of the body, each of the plurality of blades having a row of cutters disposed thereon, the rows of cutters collectively defining a cutting profile of the drill bit, wherein:

wherein a nose region and a cone region of the face, at least six radially adjacent cutters of the cutters along the cutting profile have alternating positive back rake angles;

at least some adjacent cutters of the cutters along the cutting profile have non-alternating back rake angles; and the difference between a majority of back rake angles on adjacent cutters along the cutting profile is less than 20°.

* * * * *